US005534374A

United States Patent [19]

Malhotra

[11] Patent Number: 5,534,374

[45] Date of Patent: Jul. 9, 1996

[54] MIGRATION IMAGING MEMBERS

[75] Inventor: Shadi L. Malhotra, Mississauga, Canada

[73] Assignee: Xerox Corporation, Stamford, Conn.

[21] Appl. No.: 432,380

[22] Filed: May 1, 1995

[51] Int. Cl.[6] ..... G03G 5/02

[52] U.S. Cl. ..... 430/41; 430/56

[58] Field of Search ..... 430/41

[56] References Cited

U.S. PATENT DOCUMENTS

| | | | |
|---|---|---|---|
| 3,909,262 | 9/1975 | Goffe et al. | 430/41 |
| 4,478,922 | 10/1984 | Perlstein et al. | 430/529 X |
| 4,536,457 | 8/1985 | Tam | 430/41 |
| 4,536,458 | 8/1985 | Ng | 430/41 |
| 4,618,553 | 10/1986 | Yuyama et al. | 430/56 X |
| 5,102,756 | 4/1992 | Vincett et al. | 430/41 |
| 5,215,838 | 6/1993 | Tam et al. | 430/41 |
| 5,340,676 | 8/1994 | Anderson et al. | 430/63 |

*Primary Examiner*—Roland Martin
*Attorney, Agent, or Firm*—Judith L. Byorick

[57] ABSTRACT

Disclosed is a migration imaging member comprising (a) a substrate, (b) a softenable layer situated on one surface of the substrate, said softenable layer comprising a softenable material and a photosensitive migration marking material, and (c) an antistatic layer situated on the surface of the substrate opposite to the surface in contact with the softenable layer.

39 Claims, 1 Drawing Sheet

MIGRATION IMAGING MEMBERS

BACKGROUND OF THE INVENTION

The present invention is directed to improved migration imaging members. More specifically, the present invention is directed to migration imaging members with antistatic layers. One embodiment of the present invention is directed to a migration imaging member comprising (a) a substrate, (b) a softenable layer situated on one surface of the substrate, said softenable layer comprising a softenable material and a photosensitive migration marking material, and (c) an antistatic layer situated on the surface of the substrate opposite to the surface in contact with the softenable layer.

Migration imaging systems capable of producing high quality images of high optical contrast density and high resolution have been developed. Such migration imaging systems are disclosed in, for example, U.S. Pat. Nos. 5,215,838, 5,202,206, 5,102,756, 5,021,308, 4,970,130, 4,937,163, 4,883,731, 4,880,715, 4,853,307, 4,536,458, 4,536,457, 4,496,642, 4,482,622, 4,281,050, 4,252,890, 4,241,156, 4,230,782, 4,157,259, 4,135,926, 4,123,283, 4,102,682, 4,101,321, 4,084,966, 4,081,273, 4,078,923, 4,072,517, 4,065,307, 4,062,680, 4,055,418, 4,040,826, 4,029,502, 4,028,101, 4,014,695, 4,013,462, 4,012,250, 4,009,028, 4,007,042, 3,998,635, 3,985,560, 3,982,939, 3,982,936, 3,979,210, 3,976,483, 3,975,739, 3,975,195, and 3,909,262, the disclosures of each of which are totally incorporated herein by reference, and in "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosure of which is totally incorporated herein by reference.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density (Din,n) Of an image. Optical density is measured for the purpose of this invention by diffuse densitometers with a blue Wratten No. 94 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metailized polyester substrate.

High optical density in migration imaging members allows high contrast densities in migration images made from the migration imaging members. High contrast density is highly desirable for most information storage systems. Contrast density is used herein to denote the difference between maximum and minimum optical density in a migration image. The maximum optical density value of an imaged migration imaging member is, of course, the same value as the optical density of an unimaged migration imaging member.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. Nos. 4,536,458 and 4,536,457.

Migration imaging members are also suitable for use as masks for exposing the photosensitive material in a printing plate. The migration imaging member can be laid on the plate prior to exposure to radiation, or the migration imaging member layers can be coated or laminated onto the printing plate itself prior to exposure to radiation, and removed subsequent to exposure.

U.S. Pat. No. 5,102,756 (Vincett et al.), the disclosure of which is totally incorporated herein by reference, discloses a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

Copending application U.S. Ser. No. 08/353,461, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Limburg, the disclosure of which is totally incorporated herein by reference, discloses a migration imaging member comprising a substrate, a first softenable layer comprising a first softenable material and a first migration marking material contained at or near the surface of the first softenable layer spaced from the substrate, and a second softenable layer comprising a second softenable material and a second migration marking material. Also disclosed is a migration imaging process employing the aforesaid imaging member.

Copending application U.S. Ser. No. (not yet assigned; Attorney Docket No. D/94482), mailed Mar. 24, 1995, entitled "Improved Apparatus and Process for Preparation of Migration Imaging Members," with the named inventors Philip H. Soden and Arnold L. Pundsack, the disclosure of which is totally incorporated herein by reference, discloses an apparatus for evaporation of a vacuum evaporatable material onto a substrate, said apparatus comprising (a) a walled container for the vacuum evaporatable material having a plurality of apertures in a surface thereof, said apertures being configured so that the vacuum evaporatable material is uniformly deposited onto the substrate; and (b) a source of heat sufficient to effect evaporation of the vacuum evaporatable material from the container through the apertures onto the substrate, wherein the surface of the container having the plurality of apertures therein is maintained at a temperature equal to or greater than the temperature of the vacuum evaporatable material.

While known apparatus and processes are suitable for their intended purposes, a need remains for improved migration imaging members. In addition, a need remains for migration imaging members which can be prepared by rapid processes. Migration imaging members can be prepared on coating apparatus with coating speeds of from about 0.5 feet per minute to about 150 feet per minute or more. Faster coating processes can lead to static build up in the imaging member, which may create a fire hazard. Accordingly, a need further remains for migration imaging members which can be coated at speeds of at least 50 feet per minute or more. There is also a need for migration imaging members which can be coated at speeds of 150 feet per minute or more. A need further remains for migration imaging members with increased protection from scratching when the member is handled.

SUMMARY OF THE INVENTION

It is an object of the present invention to provide migration imaging members with the above noted advantages.

It is another object of the present invention to provide improved migration imaging members.

It is yet another object of the present invention to provide migration imaging members which can be prepared by rapid processes.

It is still another object of the present invention to provide migration imaging members which can be prepared with little or no static build up during the preparation process.

Another object of the present invention is to provide migration imaging members which can be prepared with reduced or no fire hazard.

Yet another object of the present invention is to provide migration imaging members which can be prepared at coating speeds of at least 50 feet per minute or more.

Still another object of the present invention is to provide migration imaging members which can be prepared at coating speeds of 150 feet per minute or more.

It is another object of the present invention to provide migration imaging members with increased protection from scratching when the member is handled.

These and other objects of the present invention (or specific embodiments thereof) can be achieved by providing a migration imaging member comprising (a) a substrate, (b) a softenable layer situated on one surface of the substrate, said softenable layer comprising a softenable material and a photosensitive migration marking material, and (c) an antistatic layer situated on the surface of the substrate opposite to the surface in contact with the softenable layer.

DETAILED DESCRIPTION OF THE INVENTION

The present invention encompasses migration imaging members comprising a substrate, a softenable layer containing a softenable material and a photosensitive migration marking material, and an antistatic layer.

Figure 1:
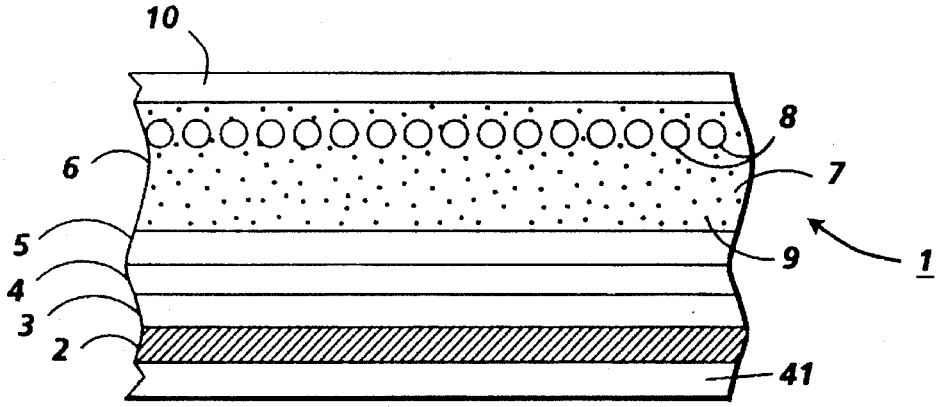
FIG. 1 illustrates schematically one migration imaging member suitable for the present invention.

An example of a migration imaging member suitable for the present invention is illustrated schematically in FIG. 1. As illustrated schematically in FIG. 1, migration imaging member 1 comprises a substrate 2, an optional adhesive layer 3 situated on the substrate 2, an optional charge blocking layer 4 situated on optional adhesive layer 3, an optional charge transport layer 5 situated on optional charge blocking layer 4, and a softenable layer 6 situated on optional charge transport layer 5, said softenable layer 6 comprising softenable material 7, migration marking material 8 situated at or near the surface of the layer spaced from the substrate, and optional charge transport material 9 dispersed throughout softenable material 7. Optional overcoating layer 10 is situated on the surface of softenable layer 6 spaced from the substrate 2. Antistatic coating 41 is situated on the surface of substrate 2 opposite to that coated with softenable layer 6. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar® (available from Du Pont) or Melinex® 442 (available from ICI Americas, Inc.), and the like. In addition, the substrate can comprise an insulative layer with a conductive coating, such as vacuum-deposited metallized plastic, such as titanized or aluminized Mylar® polyester, wherein the metailized surface is in contact with the softenable layer or any other layer situated between the substrate and the softenable layer. The substrate has any effective thickness, typically from about 6 to about 250 microns, and preferably from about 50 to about 200 microns, although the thickness can be outside these ranges.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 to about 30 microns, preferably from about 2 to about 25 microns, and more preferably from about 2 to about 10 microns, although the thickness can be outside these ranges. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the conductive layer. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 80 percent by total weight of the softenable layer, and more preferably from about 25 to about 80 percent by total weight of the softenable layer, although the amount can be outside of this range.

Examples of suitable migration marking materials include selenium, alloys of selenium with alloying components such as tellurium, arsenic, antimony, thallium, bismuth, or mixtures thereof, selenium and alloys of selenium doped with halogens, as disclosed in, for example, U.S. Pat. No. 3,312,548, the disclosure of which is totally incorporated herein by reference, and the like, phthalocyanines, and any other suitable materials as disclosed, for example, in U.S. Pat. No. 3,975,195 and other U.S. Pat. Nos. directed to migration imaging members and incorporated herein by reference.

If desired, two or more softenable layers, each containing migration marking particles, can be present in the imaging member as disclosed in copending application U.S. Ser. No. 08/353,461, filed Dec. 9, 1994, entitled "Improved Migration Imaging Members,", with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Limburg, the disclosure of which is totally incorporated herein by reference.

The migration imaging members can optionally contain a charge transport material. The charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during imaging can be of either polarity. Charge transporting materials are well known in the art. Typical charge transporting materials include the following:

Diamine transport molecules of the type described in U.S. Pat. Nos. 4,306,008, 4,304,829, 4,233,384, 4,115,116, 4,299,897, and 4,081,274, the disclosures of each of which are totally incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4 -methylphenyl)-(1,1'-biphenyl)-4,4'-diamine, N,N'-diphenyl-N,N'- bis(2-methylphenyl)-(1,1'-biphenyl)-4,4'-diamine, N,N'-diphenyl-N,N'- bis(3-ethylphenyl)-(1,1'-biphenyl)-4,4'-diamine, N,N'-diphenyl-N,N'-bis(4 -ethylphenyl)-(1,1'-biphenyl)-4,4'-diamine, N,N'-diphenyl-N,N'-bis(4-n-butylphenyl)- (1,1'-biphenyl)-4,4'-diamine, N,N'-diphenyl-N,N'-bis(3 -chlorophenyl)-[1,1'-biphenyl]-4,4'-diamine, N,N'-diphenyl-N,N'-bis(4 -chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'- bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, and 3,837,851, the disclosures of each of which are totally incorporated herein by reference. Typical pyrazoline transport molecules include 1-[lepidyl-(2)]-3-(p-diethylaminophenyl)- 5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1- [6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene, and the like.

Oxadiazole transport molecules such as 2,5-bis(4 -diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaidehyde 1,1-phenylhydrazone, 4-methoxynaphthlene- 1-carbaldeyde 1-methyl-1-phenylhydrazone, and the like. Other typical hydrazone transport molecules are described, for example in U.S. Pat. Nos. 4,150,987, 4,385,106, 4,338,388, and 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1, 1-diphenylhydrazone, and the like. Other typical carbazole phenyl hydrazone transport molecules are described, for example, in U.S. Pat. Nos. 4,256,821 and 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl-)methane, and cycloalkenyl-bis(N,N-dialkylaminoaryl-)methane as described in U.S. Pat. No. 3,820,989, the disclosure of which is totally incorporated herein by reference.

9-Fluorenylidene methane derivatives having the formula

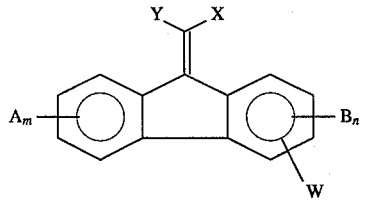

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl- 9-fluorenylidene)malonontrile, (4-phenethoxycarbonyl- 9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6 -dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro- 1,3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolyl amine, of the formula

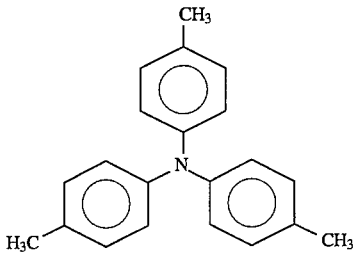

and the like, as disclosed in, for example, U.S. Pat. Nos. 3,240,597 and 3,180,730, the disclosures of which are totally incorporated herein by reference, and substituted diarylmethane and triarylmethane compounds, including bis-(4-diethylamino-2-methylphenyl)phenylmethane, of the formula

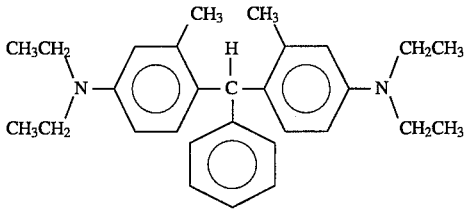

and the like, as disclosed in, for example, U.S. Pat. Nos. 4,082,551, 3,755,310, 3,647,431, British Patent 984,965, British Patent 80,879, and British Patent 1,141,666, the disclosures of which are totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

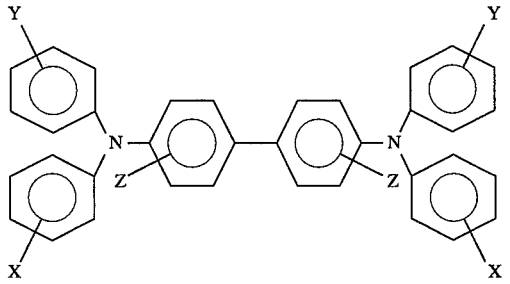

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine, results can be obtained when the softenable layer contains between about 8 percent to about 40 percent by weight of these diamine compounds based on the total weight of the softenable layer. Optimum results are achieved when the softenable layer contains between about 16 percent to about 32 percent by weight of N,N'-diphenyl-N,N'-bis(3"-methylphenyl)-(1,1'-biphenyl)-4,4'-diamine based on the total weight of the softenable layer.

The charge transport material is present in the softenable material in any effective amount, typically from about 5 to about 50 percent by weight and preferably from about 8 to about 40 percent by weight, although the amount can be outside these ranges. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional adhesive layer can include any suitable adhesive material. Typical adhesive materials include copolymers of styrene and an acrylate, polyester resin such as DuPont 49000 (available from E. I. dupont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the imaging process. It can also optionally include charge transport molecules.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the imaging process. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside these ranges.

Charge transport molecules suitable for the charge transport layer are described in detail hereinabove. The specific charge transport molecule utilized in the charge transport layer of any given imaging member can be identical to or different from the charge transport molecule employed in the adjacent softenable layer. Similarly, the concentration of the charge transport molecule utilized in the charge transport spacing layer of any given imaging member can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside this range. The charge transport material can be incorporated into the charge transport layer by techniques similar to those employed for the softenable layer.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 0.5 micron, and preferably from about 0.05 to about 0.1 micron. Typical coating processes include draw bar coating, spray coating, extrusion, dip coating, gravure roll coating, wire-wound rod coating, air knife coating and the like.

The optional overcoating layer can be substantially electrically insulating, or have any other suitable properties. The overcoating preferably is substantially transparent, at least in the spectral region where electromagnetic radiation is used for imagewise exposure step in the imaging process. The overcoating layer is continuous and preferably of a thickness up to about 1 to 2 microns. More preferably, the overcoating has a thickness of between about 0.1 and about 0.5 micron to minimize residual charge buildup. Overcoating layers greater than about 1 to 2 microns thick can also be used. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling and imaging. The overcoating layer preferably adheres strongly to the softenable layer to minimize damage. The overcoating layer can also have adhesive properties at its outer surface which provide improved resistance to toner filming during toning, transfer, and/or cleaning. The adhesive properties can be inherent in the overcoating layer or can be imparted to the overcoating layer by incorporation of another layer or component of adhesive material. These adhesive materials should not degrade the film forming components of the overcoating and preferably have a surface energy of less than about 20 ergs/cm$^2$. Typical adhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the imaging member before imaging, during imaging, after the members have been imaged.

Figure 2:
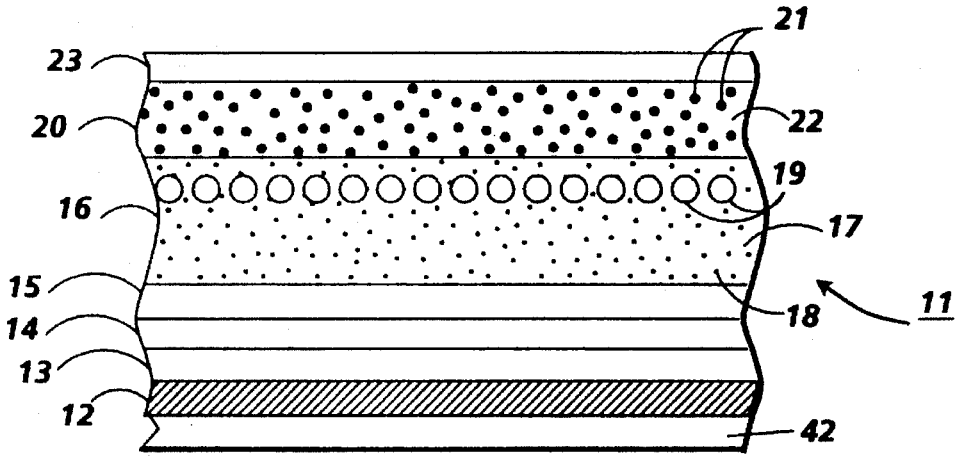
FIG. 2 illustrates schematically an infrared or red-light sensitive migration imaging member suitable for the present invention.

As illustrated schematically in FIG. 2, migration imaging member 11 comprises in the order shown a substrate 12, an optional adhesive layer 13 situated on substrate 12, an optional charge blocking layer 14 situated on optional adhesive layer 13, an optional charge transport layer 15 situated on optional charge blocking layer 14, a softenable layer 16 situated on optional charge transport layer 15, said softenable layer 16 comprising softenable material 17, charge transport material 18, and migration marking material 19 situated at or near the surface of the layer spaced from the substrate, and an infrared or red light radiation sensitive layer 20 situated on softenable layer 16 comprising infrared or red light radiation sensitive pigment particles 21 optionally dispersed in polymeric binder 22. Alternatively (not shown), infrared or red light radiation sensitive layer 20 can comprise infrared or red light radiation sensitive pigment particles 21 directly deposited as a layer by, for example, vacuum evaporation techniques or other coating methods. Optional overcoating layer 23 is situated on the surface of imaging member 11 spaced from the substrate 12. Antistatic coating 42 is situated on the surface of substrate 12 opposite to that coated with softenable layer 16.

Figure 3:
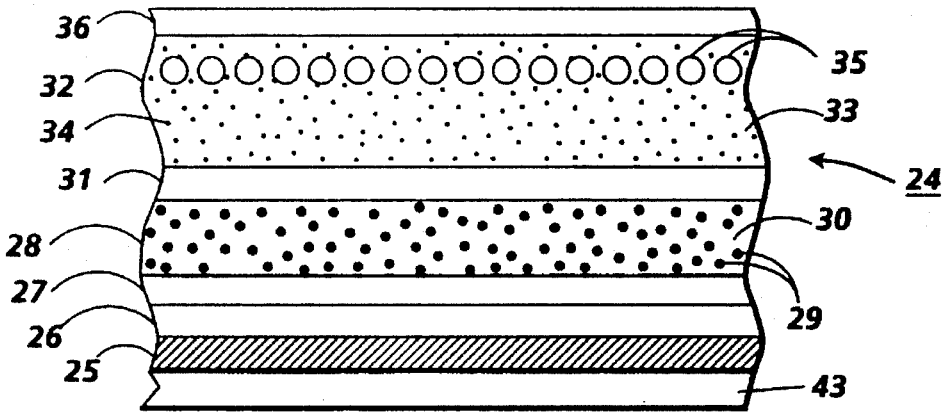
FIG. 3 illustrates schematically another infrared or red-light sensitive migration imaging member suitable for the present invention.

As illustrated schematically in FIG. 3, migration imaging member 24 comprises in the order shown a substrate 25, an optional adhesive layer 26 situated on substrate 25, an optional charge blocking layer 27 situated on optional adhesive layer 26, an infrared or red light radiation sensitive layer 28 situated on optional charge blocking layer 27 comprising infrared or red light radiation sensitive pigment particles 29 optionally dispersed in polymeric binder 30, an optional charge transport layer 31 situated on infrared or red light radiation sensitive layer 28, and a softenable layer 32 situated on optional charge transport layer 31, said softenable layer 32 comprising softenable material 33, charge transport material 34, and migration marking material 35 situated at or near the surface of the layer spaced from the substrate. Optional overcoating layer 36 is situated on the surface of imaging member 24 spaced from the substrate 25. Antistatic coating 43 is situated on the surface of substrate 25 opposite to that coated with softenable layer 32.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins (Co., St. Louis, Mo., polyvinylformals, such as Formvar 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B-90, and B-98, available from Monsanto Plastics and Resins (Co., St. Louis, Mo., Zeneca resin A622, available from Zeneca Colours, Wilmington, Del., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer comprises the binder in an amount of from about 40 to about 90 percent by weight and the pigment in an amount of from about 10 to about 60 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside these ranges. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside these ranges.

The antistatic layer generally comprises a binder and an antistatic agent. The binder and antistatic agent are present in any effective relative amounts, typically from about 5 to about 50 percent by weight antistatic agent and from about 50 to about 95 percent by weight binder, and preferably about 10 percent by weight antistatic agent and about 90 percent by weight binder, although the relative amounts can be outside this range. Typical thicknesses for the antistatic layer are from about 0.5 to about 25 microns, and preferably from about 1 to about 3 microns, although the thickness can be outside these ranges. The antistatic layer can be applied to the imaging member by any desired method, such as draw bar coating, spray coating, extrusion, dip coating, gravure roll coating, wire-wound rod coating, air knife coating, and the like. In one preferred method, the antistatic layer is coated onto the imaging member by a slot extrusion process, wherein a flat die is situated with the die lips in close proximity to the web of the substrate to be coated, resulting in a continuous film of the coating solution evenly distributed across one surface of the sheet, followed by drying in an air dryer at 100° C.

Any suitable or desired binder can be employed. Examples of suitable binders include (a) hydrophilic polysaccharides and their modifications, such as (1) starch (such as starch 5L5-280, available from St. Lawrence starch), (2) cationic starch (such as Cato-72, available from National Starch), (3) hydroxyalkylstarch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like (such as hydroxypropyl starch (#02382, available from Poly Sciences Inc.) and hydroxyethyl starch (#06733, available from Poly Sciences Inc.)), (4) gelatin (such as Calfskin gelatin #00639, available from Poly Sciences Inc.), (5) alkyl celluloses and aryl celluloses, wherein alkyl has at least one carbon atom and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like (such as methyl cellulose (Methotel AM 4, available from Dow Chemical Company)), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl, (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as hydroxyethyl cellulose (Natrosol 250 LR, available from Hercules Chemical Company), and hydroxypropyl cellulose (Klucel Type E, available from Hercules Chemical Company)), (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like (such as ethyl hydroxyethyl cellulose (Bermocoll, available from Berol Kem. A. B. Sweden)), (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxyethyl methyl cellulose (HEM, available from British Celanese Ltd., also available as Tylose MH, MHK from Kalle A. G.), hydroxypropyl methyl cellulose (Methocel K35LV, available from Dow Chemical Company), and hydroxy butylmethyl cellulose (such as HBMC, available from Dow Chemical Company)), (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dihydroxypropyl cellulose, which can be prepared by the reaction of 3-chloro-1, 2-propane with alkali cellulose), (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as hydroxypropyl hydroxyethyl cellulose, available from Aqualon Company), (11) halodeoxycellulose, wherein halo represents a halogen atom (such as chlorodeoxycellulose, which can be prepared by the reaction of cellulose with sulfuryl chloride in pyridine at 25° C.), (12) amino deoxycellulose (which can be prepared by the reaction of chlorodeoxy cellulose with 19 percent alcoholic solution of ammonia for 6 hours at 160° C.), (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as diethylammonium chloride hydroxy ethyl cellulose, available as Celquat H-100, L-200, National Starch and Chemical Company), (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom (such as hydroxypropyl trimethyl ammonium chloride hydroxyethyl cellulose, available from Union Carbide Company as Polymer JR), (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, (such as diethyl amino ethyl cellulose, available from Poly Sciences Inc. as DEAE cellulose #05178), (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, (such as carboxymethyl dextrans, available from Poly Sciences Inc. as #16058), (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as diethyl aminoethyl dextran, available from Poly Sciences Inc. as #5178), (18) amino dextran (available from Molecular Probes Inc), (19) carboxy alkyl cellulose salts, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethyl cellulose CMC 7HOF, available from Hercules Chemical Company), (20) gum arabic (such as #G9752, available from Sigma Chemical Company), (21) carrageenan (such as #C1013 available from Sigma Chemical Company), (22) Karaya gum (such as #G0503, available from Sigma Chemical Company), (23) xanthan (such as KeltroI-T, available from Kelco division of Merck and Company), (24) chitosan (such as #C3646, available from Sigma Chemical Company), (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as carboxymethyl hydroxypropyl guar, available from Auqualon Company), (26) cationic guar (such as Celanese Jaguars C-14-S, C-15, C-17, available from Celanese Chemical Company), (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin, (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like (such as dimethyl ammonium hydrolyzed collagen protein, available from Croda as Croquats), (29) agar-agar (such as that available from Pfaitz and Bauer Inc), (30) cellulose sulfate salts, wherein the cation is any conventional cation, such as sodium, lithium, potassium, calcium, magnesium, or the like (such as sodium cellulose sulfate #023 available from Scientific Polymer Products), and (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like (such as sodium carboxymethylhydroxyethyl cellulose CMHEC 43H and 37L available from Hercules Chemical Company); (b) vinyl polymers, such as (1) poly(vinyl alcohol) (such as Elvanol available from Dupont Chemical Company), (2) poly (vinyl phosphate) (such as #4391 available from Poly Sciences Inc.), (3) poly (vinyl pyrrolidone) (such as that available from GAF Corporation), (4) vinyl pyrrolidone-vinyl acetate copolymers (such as #02587, available from Poly Sciences Inc.), (5) vinyl pyrrolidone-styrene copolymers (such as #371, available from Scientific Polymer Products), (6) poly (vinylamine) (such as #1562, available from Poly Sciences Inc.), (7) poly (vinyl alcohol) alkoxylated, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl alcohol) ethoxylated #6573, available from Poly Sciences Inc.), and (8) poly (vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as poly (vinyl pyrrolidone-diethylaminomethylmethacrylate) #16294 and #16295, available from Poly Sciences Inc.); (c) formaldehyde resins, such as (1) melamine-formaldehyde resin (such as BC 309, available from British Industrial Plastics Limited), (2) urea-formaldehyde resin (such as BC777, available from British Industrial Plastics Limited), and (3) alkylated urea-formaldehyde resins, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methylated urea-formaldehyde resins, available from American Cyanamid Company as Beetle 65); (d) ionic polymers, such as (1) poly (2-acrylamide-2-methyl propane sulfonic acid) (such as #175 available from Scientific Polymer Products), (2) poly (N,N-dimethyl-3,5-dimethylene piperidinium chloride) (such as #401, available from Scientific Polymer Products), and (3) poly (methylene-guanidine) hydrochloride (such as #654, available from Scientific Polymer Products); (e) latex polymers, such as (1) cationic, anionic, and nonionic styrene-butadiene latexes (such as that available from Gen Corp Polymer Products, such as RES 4040 and RES 4100, available from Unocal Chemicals, and such as DL 6672A, DL6638A, and DL6663A, available from Dow Chemical Company), (2) ethylene-vinylacetate latex (such as Airflex 400, available from Air Products and Chemicals Inc.), (3) vinyl acetate-acrylic copolymer latexes (such as synthemul 97-726, available from Reichhold Chemical Inc, Resyn 25-1110 and Resyn 25-1140, available from National Starch Company, and RES 3103 available from Unocal Chemicals; (4) quaternary acrylic copolymer latexes, particularly those of the formula

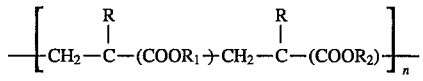

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like; (f) maleic anhydride and maleic acid containing polymers, such as (1) styrene-maleic anhydride copolymers (such as that available as Scripset from Monsanto, and the SMA series available from Arco), (2) vinyl alkyl ether-maleic anhydride copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinyl methyl ether-maleic anhydride copolymer #173, available from Scientific Polymer Products), (3) alkylene-maleic anhydride copolymers, wherein alkylene has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as ethylene-maleic anhydride copolymer #2308, available from Poly Sciences Inc., also available as EMA from Monsanto Chemical Company), (4) butadiene-maleic acid copolymers (such as #07787, available from Poly Sciences Inc.), (5) vinylalkylether-maleic acid copolymers, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as vinylmethylether-maleic acid copolymer, available from GAF Corporationas Gantrez S-95), and (6) alkyl vinyl ether-maleic acid esters, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like (such as methyl vinyl ether-maleic acid ester #773, available from Scientific Polymer Products); (g) acrylamide containing polymers, such as (1) poly (acrylamide) (such as #02806, available from Poly Sciences Inc.), (2) acrylamide-acrylic acid copolymers (such as #04652, #02220, and #18545, available from Poly Sciences Inc.), and (3) poly (N,N-dimethyl acrylamide) (such as #004590, available from Poly Sciences Inc.); and (h) poly (alkylene imine) containing polymers, wherein alkylene has two (ethylene), three (propylene), or four (butylene) carbon atoms, such as (1) poly(ethylene imine) (such as #135, available from Scientific Polymer Products), (2) poly(ethylene imine) epichlorohydrin (such as #634, available from Scientific Polymer Products), and (3) alkoxylated poly (ethylene imine), wherein alkyl has one (methoxylated), two (ethoxylated), three (propoxylated), or four (butoxylated) carbon atoms (such as ethoxylated poly (ethylene imine #636, available from Scientific Polymer Products); and the like. Any mixtures of the above ingredients in any relative amounts can also be employed.

Any desired or suitable antistatic agent can be employed Examples of suitable antistatic agents include amine acid salts and quaternary choline halides. Examples of suitable aliphatic amine acid salts include acid salts of aliphatic primary amines, such as (I) acid salts of aliphatic diamines, of the general formula $H_2N(R_1)NH_2.H_nX^{n-}$, wherein $R_1$ can be (but is not limited to) alkyl, substituted alkyl (such as imino alkyl imine, imino alkyl imino carbonyl, dialkyl imine, or the like), alkylene, substituted alkylene (such as alkylene imine, oxyalkylene, alkylene carbonyl, mercapto alkylene, or the like), imine, diamino imine, and carbonyl, X is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (a) guanidine compounds, such as (1) guanidine hydrochloride [$H_2NC(=NH)NH_2.HCl$] (Aldrich 17,725-3, G1,170-5); (2) guanidine sulfate [$H_2NC(=NH)NH_2]_2.H_2SO_4$ (Aldrich 30,739-4); (3) guanidine nitrate [$H_2NC(=NH)NH_2.HNO_3$] (Aldrich 23,424-9); (4) guanidine carbonate [$H_2NC(=NH)NH_2]_2.H_2CO_3$ (Aldrich G1,165-9); (5) guanidine thiocyanate [$H_2NC(=NH)NH_2.HSCN$] (Aldrich 29,288-5); (6) amino guanidine bicarbonate [$H_2NNHC(=NH)NH_2.H_2CO_3$] (Aldrich 10,926-6); (7) amino guanidine nitrate [$H_2NNHC(=NH)NH_2.HNO_3$] (Aldrich A5,610-8); (8) amino guanidine hemisulfate [$NH_2NHC(=NH)NH_2].H_2SO_4$ (Kodak 4023, available from Eastman Kodak Co.); (9) 1,3-diamino guanidine monohydrochloride [$H_2NNHC(=NH)NHNH_2.HCl$] (Aldrich 14,341-3); (10) N-guanyl urea sulfate hydrate [$H_2NC(=NH)NHCONH_2]_2.H_2SO_4.xH_2O$ (Aldrich 27,345-7); (11) (4-amino butyl) guanidine sulfate $H_2N(CH_2)_4NHC(=NH)NH_2.H_2SO_4$ (Aldrich 10,144-3); (12) malonamamidine hydrochloride $H_2NC(=NH)CH_2CONH_2.HCl$ (Aldrich 17,651-6); and the like; (b) alkylene compounds, such as (1) ethylene diamine dihydrochloride $H_2N(CH_2)_2NH_2.2HCl$ (Aldrich 19,580-4); (2) 1,3-diaminopropane dihydrochloride $H_2N(CH_2)_3NH_2.2HCl$ (Aldrich D2,380-7); (3) 1,4-diamino butane dihydrochloride $H_2N(CH_2)_4NH_2.2HCl$ (Aldrich 23,400-1); (4) 1,5-diamino pentane dihydrochloride $H_2N(CH_2)_4NH_2.2HCl$ (Aldrich 27,182-9); (5) 1,6-diamine hexane dihydrochloride $H_2N(CH_2)_6NH_2.2HCl$ (Aldrich 24,713-1); (6) triethylene tetramine dihydrochloride $H_2N(CH_2)_2NH(CH_2)_2NH(CH_2)_2NH_2.2HCl$ (Aldrich 29,951-0); (7) triethylene tetramine tetrahydrochloride $H_2N(CH_2)_2NH(CH_2)_2NH(CH_2)_2NH_2.4HCl$ (Aldrich 16,196-9); (8) spermine tetrahydrochloride $H_2N(CH_2)_3NH(CH_2)_4NH_2.4HCl$ (Aldrich 28,716-4); (9) spermidine trihydrochloride $H_2N(CH_2)_4NH(CH_2)_3NH_2.3HCl$ (Aldrich 23,399-4); (10) cystamine dihydrochloride $S_2(CH_2CH_2NH_2)_2.2HCl$ (Aldrich C12,150-9); (11) 2,2'-oxybis (ethylamine) dihydrochloride $O(CH_2CH_2NH_2)_2.2HCl$ (Aldrich 17,609-5); (12) glycinamide hydrochloride $H_2NCH_2CONH_2.HCl$ (Aldrich G610-4); (13) 1,3-diamino acetone dihydrochloride monohydrate $H_2NCH_2COCH_2NH_2.2HCl.H_2O$ (Aldrich 23,244-0); (14) urea sulfate $(H_2NCONH_2)_2.H_2SO_4$ (Aldrich 28,059-3); (15) urea phosphate $H_2NCONH_2.H_3PO_4$ (Aldrich 29,282-6); (16) 2,2-dimethyl-1,3-propane diamine dihydrochloride $H_2NCH_2C(CH_3)_2CH_2NH_2.2HCl$ (Aldrich 22,693-9); (17) 1,4-diamino-2-butanone dihydrochloride $H_2NCH_2CH_2COCH_2CH_2NH_2.2HCl$ (Aldrich 19, 933-8); (18) L-leucinamide hydrochloride $(CH_3)_2CHCH_2CH(NH_2)CONH_2.HCl$ (Aldrich 28,642-7); (19) (2 -aminoethyl) trimethyl ammonium chloride hydrochloride $H_2NCH_2CH_2N(CH_3)_3Cl.HCl$ (Aldrich 28,455-6); and the like; (II) acid salts of aliphatic monoamines, of the general formula $R_2NH_2.H_nX^{n-}$, wherein $R_2$ can be (but is not limited to) alkyl, substituted alkyl (such as alkyl imine, alkoxy alkyl imine, alkyl amino imine, halogenated alkyl imine, alkyl mercaptylimine, alkylamine alkoxy amine, alkyl mercapto amine, halogenated alkyl amine, halogenated alkyl amide, alkyl ester, allyl alkyl amine, alkyl mercaptyl ester, and the like), alkylene, substituted alkylene (such as alkylene imine, alkylene ester, and the like), imine, amine, substituted amine (such as hydroxylamine, alkyne hydroxyl amino, halogenated amine, and the like), anhydride ester, and the like, X is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (a) guanidine compounds, such as (1) formamidine hydrochloride $HC(=NH)NH_2.HCl$ (Aldrich 26,860-7); (2) formamidine disulfide dihydrochloride [$-SC(=NH)NH_2]_2.2HCl$ (Aldrich 21,946-0); (3) formamidine acetate $HC(=NH)NH_2.CH_3COOH$ (Aldrich F1,580-3); (4) acetamidine hydrochloride $CH_3C(=NH)NH_2.HCl$ (Aldrich 15,915-8); (5) acetamidine acetate $H_3CC(=NH)NH_2.CH_3COOH$ (Aldrich 26,997-2); (6) 2-ethyl- 2-thiopseudo urea hydrobromide $C_2H_5SC(=NH)NH_2.HBr$ (Aldrich 30,131-0); (7) guanidine acetic acid [$H_2NC(=NH)NHCH_2COOH$] (Aldrich G1,160-8); (8) 1,1-dimethyl biguanide hydrochloride [$(CH_3)_2NC(=NH)NHC(=NH)NH_2.HCl$] (Aldrich D15,095-9); (9) 1-methyl guanidine hydrochloride $CH_3NHC(=NH)NH_2.HCl$ (Aldrich 22,240-2); (10) methyl guanidine sulfate [$CH_3NHC(=NH)NH_2]_2.H_2SO_4$ (Kodak 1482, available from Eastman Kodak Co.); (11) 1-ethyl guanidine hydrochloride $C_2H_5NHC(=NH)NH_2.HCl$ (Aldrich 29,489-6); (12) 1-ethyl guanidine sulfate [$C_2H_5NHC(=NH)NH_2]_2.H_2SO_4$ (Aldrich 27,555-7); (13) dodecyl guanidine hydrochloride [$CH_3(CH_2)_{11}HNC(=NH)NH_2.HCl$] (Betz Paper Company Slimetrol RX=31, 32); (14) 1-(2,2-diethoxyethyl) guanidine sulfate [$(C_2H_5O)_2CHCH_2NHC(=NH)NH_2]_2.H_2SO_4$ (Aldrich 19,790-4); (15) methyl glyoxal bis (guanyl hydrazone) dihydrochloride hydrate $CH_3C[=NNHC(=NH)NH_2]CH[=NNHC(=NH)NH_2].2HCl.xH_2O$ (Aldrich 13,949-1); (16) 2-ethyl-2-thiopseudourea hydrobromide $C_2H_5SC(=NH)NH_2.HBr$ (Aldrich 30,131-0); (17) 2-methyl-2-thiopseudourea sulfate [$CH_3SC(=NH)NH_2]_2.H_2SO_4$ (Aldrich M8,444-5); (18) o-methyl isourea hydrogen sulfate $CH_3OC(=NH)NH_2.H_2SO_4$ (Aldrich M5,370-1); (19) S,S'-(1, 3-propanediyl)bis(isothiouronium bromide) $CH_2[CH_2SC(=NH)NH_2]_2.2HBr$ (Aldrich 24,318-3); and the like; (b) alkyl amines, such as (1) methyl amine hydrochloride $CH_3NH_2.HCl$ (Aldrich 12,970-4); (2) ethyl amine hydrochloride $C_2H_5NH_2.HCl$ (Aldrich 23,283-1); (3) 3-chloropropylamine hydrochloride $Cl(CH_2)_3NH_2.HCl$ (Aldrich 14,254-9); (4) aminomethyl cyclopropane hydrochloride $C_3H_5CH_2NH_2.HCl$ (Aldrich A6,380-5); (5) 2 -methyl allyl amine hydrochloride $H_2C{=}C(CH_3)CH_2NH_2.HCl$ (Aldrich 27,906-4); (6) amino acetonitrile hydrochloride $H_2N(CH_2CN).HCl$ (Aldrich 13,052-4); (7) amino acetonitrile bisulfate $H_2N(CH_2CN).H_2SO_4$ (Aldrich 27,999-4); (8) tert-butyl hydrazine hydrochloride $(CH_3)_3CNHNH_2.HCl$ (Aldrich 19,497-2); (9) methoxyl amine hydrochloride $CH_3ONH_2.HCl$ (Aldrich 22,551-7); (10) ethanol amine hydrochloride $H_2NCH_2CH_2OH.HCl$ (Aldrich 23,638-1); (11) O-(tert butyl) hydroxylamine hydrochloride $(CH_3)_3CONH_2.HCl$ (Aldrich 34,006-5); (12) 6-amino-2-methyl-2-heptanol hydrochloride $CH_3CH(NH_2)(CH_2)_3C(CH_3)_2OH.HCl$ (Aldrich 29,620-1); (13) o-allyl hydroxyl amine hydrochloride hydrate $H_2C{=}CHCH_2ONH_2.HCl.xH_2O$ (Aldrich 25,456-8); (14) hydroxylamine hydrochloride $H_2NOH.HCl$ (Aldrich 25,558-0; 15,941-7); (15) hydroxylamine phosphate $(H_2NOH)_3.H_3PO_4$ (Aldrich 34,235-1); (16) hydroxylamine sulfate $(H_2NOH)_2.H_2SO_4$ (Aldrich 21,025-1); (17) D,L-serinol hydrochloride $H_2NCH(CH_2OH)_2.HCl$ (Aldrich 28,715-6); (18) 2-(ethylthio) ethylamine hydrochloride $C_2H_5SCH_2CH_2NH_2.HCl$ (Aldrich 12,042-1); (19) o-ethyl hydroxylamine hydrochloride $C_2H_5ONH_2.HCl$ (Aldrich 27,499-2); (20) tris (hydroxymethyl) aminomethane hydrochloride $(HOCH_2)_3CNH_2.HCl$ (Aldrich 85,764-5); (21) octadecylamine hydrochloride $CH_2(CH_2)_{17}NH_2.HCl$ (Kodak 9209, available from Eastman Kodak Co.); (22) 2-aminoethyl hydrogen sulfate $NH_2CH_2CH_2OSO_3H$ (Kodak P5895, available from Eastman Kodak Co.); (23) 2-aminoethane thiosulfuric acid $NH_2CH_2CH_2SSO_3H$ (Kodak 8413, available from Eastman Kodak Co.); (24) 2-bromoethylamine hydrobromide $BrCH_2CH_2NH_2.HBr$ (Kodak 5020, available from Eastman Kodak Co.); and the like; (c) ester compounds, such as (1) glycine methylester hydrochloride $H_2NCH_2COOCH_3.HCl$ (Aldrich G-660-0); (2) L-methionine methyl ester hydrochloride $CH_3SCH_2CH_2CH(NH_2)COOCH_3.HCl$ (Aldrich 86,040-9); (3) L-alanine methyl ester hydrochloride $CH_3CH(NH_2)COOCH_3.HCl$ (Aldrich 33,063-9); (4) L-leucine methyl ester hydrochloride $(CH_3)_2CHCH_2CH(NH_2)COOCH_3.HCl$ (Aldrich L100-2); (5) glycine ethyl ester hydrochloride $H_2NCH_2COOC_2H_5.HCl$ (Aldrich G650-3); (6) β-alanine ethyl ester hydrochloride $H_2N(CH_2)_2COOC_2H_5.HCl$ (Aldrich 30,614-2); (7) ethyl 4-aminobutyrate hydrochloride $H_2N(CH_2)_3COOC_2H_5.HCl$ (Aldrich E1,060-2); (8) alanine ethyl ester hydrochloride $CH_3CH(NH_2)COOC_2H_5.HCl$ (Aldrich 26,886-0; 85,566-9); (9) L-methionine ethyl ester hydrochloride $CH_3SCH_2CH_2CH(NH_2)COOC_2H_5.HCl$ (Aldrich 22,067-1); (10) glycine tert butyl ester hydrochloride $H_2NCH_2COOC(CH_3)_3.HCl$ (Aldrich 34,795-7); (11) L-valine ethyl ester hydrochloride $(CH_3)_2CHCH(NH_2)COOC_2H_5.HCl$ (Aldrich 22,069-8); (12) L-valine methylester hydrochloride $(CH_3)_2CHCH(NH_2)COOCH_3.HCl$ (Aldrich 86,027-1); (13) N-α-acetyl-L-lysine methylester hydrochloride $H_2N(CH_2)_4CH(NHCOCH_3)COOCH_3.HCl$ (Aldrich 85,909-5); (14) methyl 5-aminolevulinate hydrochloride $H_2NCH_2COCH_2COOCH_3.HCl$ (Aldrich 28,506-4); and the like.

Also suitable are acid salts of aliphatic secondary amines, such as (III) those of the general formula $R_3R_4NH.H_nX^{n-}$, wherein $R_3$ and $R_4$ each, independently of one another, can be (but are not limited to) alkyl (includingcyclic alkyl), substituted alkyl (such as hydroxyalkyl, alkoxy alkyl, alkyl nitride, alkylene alkyl, or the like), alkylene, substituted alkylene (such as alkoxy alkylene or the like), hydroxyl, nitrile, oxyalkyl, oxyalkylene, and the like, X is an anion, such as $Cl^-$, $Br^-$, $I^-$, $HSO_4^-$, $SO_4^{2-}$, $NO_3^-$, $HCOO^-$, $CH_3HCOO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (1)dimethylamine hydrochloride $(CH_3)_2NH.HCl$ (Aldrich 12,636-5); (2) diethyl amine hydrochloride $(C_2H_5)_2NH.HCl$ (Aldrich 12,774-4); (3) diethyl amine hydrobromide $(C_2H_5)_2NH.HBr$ (Aldrich 31,090-5); (4) diethyl amine phosphate $(C_2H_5)_2NH.H_3PO_4$ (Aldrich 14,115-1); (5) N-propylcyclopropane methyl amine hydrochloride $C_3H_5CH_2NHCH_2CH_2CH_3.HCl$ (Aldrich 22,758-7); (6) isopropyl formimidate hydrochloride $HC({=}NH)OCH(CH_3)_2.HCl$ (Aldrich 34,624-1); (7) N-isopropyl hydroxylamine hydrochloride $(CH_3)_2CHNHOH.HCl$ (Aldrich 24,865-7); (8) N-(tert butyl) hydroxylamine hydrochloride $(CH_3)_3CNHOH.HCl$ (Aldrich 19,475-1); (9) dimethyl suberimidate dihydrochloride $CH_3OC({=}NH)(CH_2)_6C({=}NH)OCH_3.2HCl$ (Aldrich 17,952-3); (10) N-methylhydroxylamine hydrochloride $CH_3NHOH.HCl$ (Aldrich M5,040); (11) methyl amino acetonitrile hydrochloride $CH_3NHCH_2CN.HCl$ (Aldrich M2,810-3); (12) N-cyclohexyl hydroxylamine hydrochloride $C_6H_{11}NHOH.HCl$ (Aldrich 18,646-5); (13) dimethyl adipimidate dihydrochloride $CH_3OC({=}NH)(CH_2)_4C({=}NH)OCH_3.2HCl$ (Aldrich 28,562-5); and the like.

Also suitable are acid salts of aliphatic tertiary amines, such as (IV) those of the general formula $R_5R_6R_7(N).H_nX^{n-}$, wherein $R_5$, $R_6$, and $R_7$ each, independently of one another, can be (but are not limited to) alkyl, substituted alkyl (such as hydroxyalkyl, alkyl halide, alkyl carbonyl, and the like), alkylene, substituted alkylene (such as hydroxy alkylene and the like), alkoxy, thiol, carboxyl, and the like, X is an anion, such as $Cl^-$, $Br^-$, $I^-$, $HSO_4^-$, $SO_4^{2-}$, $NO_3^-$, $HCOO^-$, $CH_3HCOO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (1) trimethylamine hydrochloride $(CH_3)_3N.HCl$ (Aldrich T7,276-1); (2) triethylamine hydrochloride $(C_2H_2)_3N.HCl$ (Aldrich 26,815-1); (3) triethanol amine hydrochloride $(HOCH_2CH_2)_3N.HCl$ (Aldrich 15,891-7); (4) 2-dimethyl amino isopropyl chloride hydrochloride $CH_3CH(Cl)CH_2N(CH_3)_2.HCl$ (Aldrich D14,240-9); (5) 2-dimethyl amino ethyl chloride hydrochloride $(CH_3)_2NCH_2CH_2Cl.HCl$ (Aldrich D14,120-8); (6) 3-dimethyl amino-2-methyl propyl chloride hydrochloride $(CH_3)_2NCH_2CH(CH_3)CH_2Cl.HCl$ (Aldrich 15,289-7); (7) 2-dimethyl aminoethanethiol hydrochloride $(CH_3)_2NCH_2CH_2SH.HCl$ (Aldrich, D14,100-3); (8) N,N-dimethyl glycine hydrochloride $(CH_3)_2NCH_2COOH.HCl$ (Aldrich 21,960-6); (9) 4-(dimethyl amino) butyric acid hydrochloride $(CH_3)_2N(CH_2)_3COOH.HCl$ (Aldrich 26,373-7); (10) N,N-dimethyl hydroxylamine hydrochloride $HON(CH_3)_2.HCl$ (Aldrich 22,145-7); (11) N,O-dimethyl hydroxylamine hydrochloride $CH_3ONHCH_3.HCl$ (Aldrich D 16,3780-8); (12) 3-[bis(2-hydroxyethyl) amino]-2 -hydroxy-1-propane sulfonic acid $(HOCH_2CH_2)_2NCH_2CH(OH)CH_2SO_3H$ (Aldrich 34,004-9); (13) 2,3-bis (hydroxyamino)-2,3-dimethyl butane sulfate $(CH_3)_2C(NHOH)C(NHOH)(CH_3)_2.H_2SO_4$ (Kodak 11659, available from Eastman Kodak Co.); (14) N,N-bis (2-hydroxyethyl)-2-amino ethane sulfonic acid $(HOCH_2CH_2)_2NCH_2CH_2SO_3H$ (Kodak 14999, available from Eastman Kodak Co.); and the like.

Also suitable are (V) acid salts of cyclic aliphatic amines, such as (1) (±)-α-amino-δ-butyrolactone hydrobromide (Aldrich A4, 450-9), of the formula

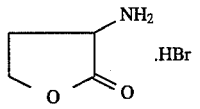

(2) D,L-homocysteine thiolactone hydrochloride (Aldrich H1,580-2), of the formula

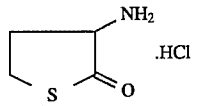

(3) (±)-endo-2-aminonorbornane hydrochloride (Aldrich 13, 351-5), of the formula

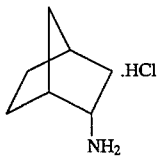

(4) N-ethyl-3-phenyl-2-norbornanamine hydrochloride (Aldrich 17, 951-5), of the formula

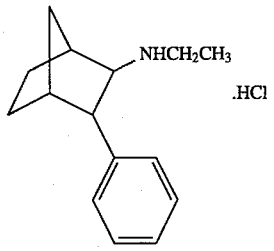

(5) 1-adamantanamine hydrochloride (Aldrich 11,519-3), of the formula

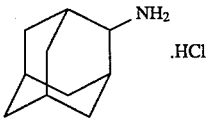

(6) 1,3-adamantane diamine dihydrochloride (Aldrich 34, 081-2), of the formula

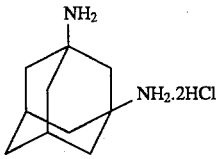

(7) 3-noradamantanamine hydrochloride (Aldrich 29, 187-0), of the formula

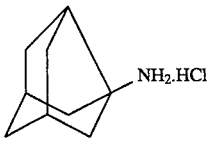

(8) 9-aminofluorene hydrochloride (Aldrich A5, 560-8), of the formula

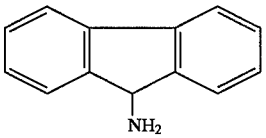

and the like.

Also suitable are acid salts of aromatic amines, such as (VI) acid salts of aromatic amines having both —$NH_2$ and —OH groups, such as (1) (±)-octopamine hydrochloride $HOC_6H_4CH(CH_2NH_2)OH.HCl$ (Aldrich 13,051-6); (2) (±)-norphenylephrine hydrochloride $HOC_6H_4CH(CH_2NH_2)OH.HCl$ (Aldrich 11,372-7); (3) norephedrine hydrochloride $C_6H_5CH(OH)CH(CH_3)NH_2.HCl$ (Aldrich 13,143-1, 19,362-3); (4) norepinephrine hydrochloride $(HO)_2C_6H_3CH(CH_2NH_2)OH.HCl$ (Aldrich 17,107-7); (5) (IR,2R)-(−)-norpseudoephedrine hydrochloride $C_6H_5CH(OH)CH(CH_3)NH_2.HCl$ (Aldrich 19,363-1); (6) (±)-α-(1-aminoethyl)-4 -hydroxybenzyl alcohol hydrochloride $HOC_6H_4CH[CH(NH_2)CH_3]OH.HCl$ (Aldrich A5,445-8); (7) 2[2-(aminomethyl)phenylthio]benzylalcohol hydrochloride $H_2NCH_2C_6H_4SC_6H_4CH_2OH.HCl$ (Aldrich 34,632-2); (8) 1-amino-2-naphthol hydrochloride $H_2NC_{10}H_6OH.HCl$ (Aldrich 13,347-7); (9) 4 -amino-1-naphthol hydrochloride $H_2NC_{10}H_6OH.HCl$ (Aldrich 13,348-5); (10) tyramine hydrochloride $HOC_6H_4CH_2CH_2NH_2.HCl$ (Aldrich T9,035-2); (11) L-tyrosine hydrochloride $HOC_6H_4CH_2CH(NH_2)COOH.HCl$ (Aldrich 28,736-9); (12) O-methyldopamine hydrochloride $CH_3OC_6H_3(OH)CH_2CH_2NH_2.HCl$ (Aldrich 19,596-0, Aldrich 16,431-3); (13) hydroxy dopamine hydrochloride $(HO)_3C_6H_2CH_2CH_2NH_2.HCl$ (Aldrich 15,156-4, 14,980-2); (14) hydroxy dopamine hydrobromide $(HO)_3C_6H_2CH_2CH_2NH_2.HBr$ (Aldrich 16,295-7); (15) 3-hydroxytyramine hydrochloride $(HO)_2C_6H_3CH_2CH_2NH_2.HCl$ (Aldrich H6,025-5); (16) 3-hydroxytyramine hydrobromide $(HO)_2C_6H_3CH_2CH_2NH_2.HBr$ (Aldrich 16, 113-6); (17) o-benzyl hydroxyl amine hydrochloride $C_6H_5CH_2ONH_2.HCl$ (Aldrich B2,298-4); (18) aminomethyl-1-cyclohexanol hydrochloride $H_2NCH_2C_6H_{10}OH.HCl$ (Aldrich 19,141-8); (19) 2-amino cyclohexanol hydrochloride $H_2NC_6H_{10}OH.HCl$ (Aldrich 26,376-1); (20) 4-amino-2,3-dimethyl phenol hydrochloride $H_2NC_6H_2(CH_3)_2OH.HCl$ (Aldrich 24,416-3); (21) 4-(2-hydroxyethylthio)l-3-phenylenediamine dihydrochloride $HO(CH_2CH_2S)C_6H_3(NH_2)_2.2HCl$ (Aldrich 20,923-6); (22) 2-amino-3-hydroxy benzoic acid hydrochloride $HOC_6H_3NH_2COOH.HCl$ (Aldrich 30,690-8); (23) 4-hydroxy-3-methoxy benzyl amine hydrochloride $HOC_6H_3(OCH_3)CH_2NH_2.HCl$ (Aldrich H3,660-5); (24) 4-amino phenol hydrochloride $H_2NC_6H_4OH.HCl$ (Aldrich 27,406-2); (25) 2-[2-(aminomethyl) phenyl thio] benzyl alcohol hydrochloride $H_2NCH_2C_6H_4SC_6H_4CH_2OH.HCl$ (Aldrich 34,632-2); (26) amino diphenyl methane hydrochloride $(C_6H_5)_2CHNH_2.HCl$ (Aldrich 17,688-5); (27) (4-aminophenyl) trimethyl ammonium iodide hydrochloride $(CH_3)_3N(I)C_6H_4NH_2.HCl$ (Kodak 11372, available from Eastman Kodak Co.); (28) 4-aminoantipyrine hydrochloride (Kodak 6535, available from Eastman Kodak Co.), of the formula

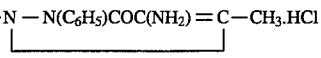

$$CH_3-N-N(C_6H_5)COC(NH_2)=C-CH_3.HCl$$

and the like.

Also suitable are (VII) acid salts of aromatic amines having a hydrazine (—$NRNH_2$) group, wherein R is hydrogen, alkyl, or aryl, such as (1) tolylhydrazine hydrochloride $CH_3C_6H_4NHNH_2.HCl$ (Aldrich 28,190-5, T4,040-1, T4,060-6); (2) 3-chloro-p-tolyl hydrazine hydrochloride $ClC_6H_3(CH_3)NHNH_2.HCl$ (Aldrich 15,343-5); (3) 4-chloro-o-tolylhydrazine hydrochloride $ClC_6H_3(CH_3)NHNH_2.HCl$ (Aldrich 15,283-8); (4) chlorophenyl hydrazine hydrochloride $ClC_6H_4NHNH_2.HCl$ (Aldrich 10,950-9; 15,396-6; C6,580-7); (5) 3-nitrophenyl hydrazine hydrochloride $O_2NC_6H_4NHNH_2.HCl$ (Aldrich N2,180-4); (6) 4-isopropyl phenylhydrazine hydrochloride $(CH_3)_2CHC_6H_4NHNH_2.HCl$ (Aldrich 32,431-0); (7) dimethyl phenyl hydrazine hydrochloride hydrate $(CH_3)_2C_6H_3NHNH_2.HCl.xH_2O$ (Aldrich 32,427-2, 32,428-0; 32,429-9); (8) 1,1-diphenyl hydrazine hydrochloride $(C_6H_5)_2NNH_2.HCl$ (Aldrich 11,459-6); (9) 3-hydroxybenzyl hydrazine dihydrochloride $HOC_6H_4CH_2NHNH_2.2HCl$ (Aldrich 85,992-3); and the like.

Also suitable are (VIII) acid salts of aromatic diamine and substituted diamine containing compounds, such as (1) phenylene diamine dihydrochloride $C_6H_4(NH_2)_2.2HCl$ (Aldrich 23,590-3, 13,769-3); (2) N,N-dimethyl-1,3-phenylene diamine dihydrochloride $(CH_3)_2NC_6H_4NH_2.2HCl$ (Aldrich 21,922-3); (3) N,N-dimethyl-1,4-phenylene diamine monohydrochloride $(CH_3)_2NC_6H_4NH_2.HCl$ (Aldrich 27,157-8); (4) N,N-dimethyl-1,4-phenylene diamine dihydrochloride $(CH_3)_2NC_6H_4NH_2.2HCl$ (Aldrich 21,923-1); (5) N,N-dimethyl-1,4-phenylene diamine sulfate $(CH_3)_2NC_6H_4NH_2.H_2SO_4$ (Aldrich 18,638-4); (6) 4,4'-diamino diphenylamine sulfate $(H_2NC_6H_4)_2NH.H_2SO_4$ (Aldrich D1,620-7); (7) N,N-diethyl- 1,4-phenylene diamine sulfate $(C_2H_5)_2NC_6H_4NH_2.H_2SO_4$ (Aldrich 16,834-3); (8) 2,4-diamino phenol dihydrochloride $(H_2N)_2C_6H_3OH._2HCl$ (Aldrich 23,010-3); (9) 4-(dimethyl amino) benzyl amine dihydrochloride $(CH_3)_2NC_6H_4CH_2NH_2.2HCl$ (Aldrich 28,563-3); (10) 3,3'-dimethoxy benzidine hydrochloride hydrate $[—C_6H_3(OCH_3)NH_2]_2.xHCl.xH_2O$ (Aldrich 19, 124-8); (11) 4,4'-diaminostilbene dihydrochloride $H_2NC_6H_4CH{=}CHC_6H_4NH_2.2HCl$ (Aldrich D2,520-6); (12) 4-(aminomethyl) benzene sulfonamide hydrochloride hydrate $H_2NCH_2C_6H_4SO_2NH_2.HCl.xH_2O$ (Aldrich A6,180-2); (13) 4-methoxy-1,2-phenylene diamine dihydrochloride $CH_3OC_6H_3(NH_2)_2.2HCl$ (Aldrich M2,040-4); (14) procaine hydrochloride $H_2NC_6H_4COOCH_2CH_2N(C_2H_5)_2.HCl$ (Aldrich 22,297-6); (15) procain amide hydrochloride $H_2NC_6H_4CONHCH_2CH_2N(C_2H_5)_2.HCl$ (Aldrich 22,296-8); (16) 3,3',5,5'-tetramethyl benzidine dihydrochloride hydrate $[C_6H_2(CH_3)_2\text{-}4\text{-}NH_2]_2.2HCl.xH_2O$ (Aldrich 86,151-0); (17) N-(1-naphthyl) ethylene diamine dihydrochloride $C_{10}H_7NHCH_2CH_2NH_2.2HCl$ (Aldrich 22,248-8); (18) D,L-alanine-2-naphthylamide hydrochloride $CH_3CH(NH_2)CONHC_{10}H_7.HCl$ (Aldrich 85,677-0); (19) N-(4-methoxyphenyl)- 1,4-phenylene diamine hydrochloride $CH_3OC_6H_4NHC_6H_4NH_2.HCl$ (Aldrich 21,702-6); (20) 2-methoxy-1,4-phenylene diamine sulfate hydrate $CH_3OC_6H_3(NH_2)_2.H_2SO_4.xH_2O$ (Aldrich 17,006-2); (21) 2,2-dirnethyl,-1,3-propane diamine dihydrochloride $H_2NCH_2C(CH_3)_2CH_2NH_2.2HCl$ (Aldrich 22,693-9); and the like.

Also suitable are (IX) acid salts of aromatic guanidine compounds, of the general formula $R_8\text{-}C(=NH)NH_2.H_nX^-$, wherein $R_8$ can be (but is not limited to) aryl (such as phenyl or the like), substituted aryl (such as amino phenyl, amido phenyl, or the like), arylalkyl (such as benzyl and the like), substituted arylalkyl (such as amino alkyl phenyl, mercaptyl benzyl, and the like) and the like, X is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (1) benzamidine hydrochloride $C_6H_5C(=NH)NH_2.HCl$ (Kodak 6228, available from Eastman Kodak Co.) and benzamidine hydrochloride hydrate $C_6H_5C(=NH)NH_2.HCl.xH_2O$ (Aldich B 200-4); (2) 4-amidino benzamide hydrochloride $H_2NC(=NH)C_6H_4CONH_2.HCl$ (Aldrich 24,781-2); (3) 3-aminobenzamidine dihydrochloride $H_2NC_6H_4C(=NH)NH_2.2HCl$ (Aldrich 85,773-4); (4) 4-aminobenzamidine dihydrochloride $H_2NC_6H_4C(=NH)NH_2.2HCl$ (Aldrich 85,766-1); (5) 1-(3-phenyl propyl amino) guanidine hydrochloride $C_6H_5(CH_2)_3NHNHC(=NH)NH_2.HCl$ (Aldrich 22, 161-9); (6) 2-benzyl-2-thiopseudourea hydrochloride $C_6H_5CH_2SC(=NH)NH_2.HCl$ (Aldrich 25,103-8); and the like.

Also suitable are (X) acid salts of aromatic monoamines, such as those of the general formula $R_9\text{-}NH_2.H_nX^{n-}$, wherein $R_9$ can be (but is not limited to) aryl (such as phenyl or the like), substituted aryl (such as phenyl alkyl, phenyl cyclic alkyl, phenyl alkyl carbonyl halide, phenyl alkyl carbonyl halide, or the like), arylalkyl, substituted arylalkyl (such as alkoxy phenyl alkyl, aryloxy phenyl alkyl, aryloxy alkyl, or the like), or the like, and X is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, or the like, as well as mixtures thereof, and n is an integer of 1, 2, or 3, including (1) 2-phenyl cyclopropyl amine hydrochloride $C_6H_5C_3H_4NH_2.HCl$ (Aldrich P2,237-0); (2) amino diphenyl methane hydrochloride $(C_6H_5)_2CHNH_2.HCl$ (Aldrich 17,688-5); (3) (R)-(−)-2-phenyl glycine chloride hydrochloride $C_6H_5CH(NH_2)COCl.HCl$ (Aldrich 34,427-3); (4) phenethylamine hydrochloride $C_6H_5(CH_2)_2NH_2.HCl$ (Aldrich 25,041-4); (5) 2, 4-dimethoxybenzylamine hydrochloride $(CH_3O)_2C_6H_3CH_2NH_2.HCl$ (Aldrich 17,860-8); (6) 3,4-dibenzyloxy phenethyl amine hydrochloride $(C_6H_5CH_2O)_2C_6H_3CH_2CH_2NH_2.HCl$ (Aldrich 16,189-6); (7) 2,2-diphenyl propylamine hydrochloride $CH_3C(C_6H_5)_2CHNH_2.HCl$ (Aldrich 18,768-2); (8) 2,4,6-trimethoxy benzylamine hydrochloride $(CH_3O)_3C_6H_2CH_2NH_2.HCl$ (Aldrich 30,098-5); (9) 4-benzyloxyaniline hydrochloride $C_6H_5CH_2OC_6H_4NH_2.HCl$ (Aldrich 11,663-7); (10) benzylamine hydrochloride $C_6H_5CH_2NH_2.HCl$ (Aldrich 21,425-6); and the like.

Also suitable are (XI) acid salts of aromatic amino esters, such as (1) N-α-p-tosyl-L-arginine methylester hydrochloride $H_2NC(=NH)NH(CH_2)_3CH(NHSO_2C_6H_4CH_3)COOCH_3.HCl$ (Aldrich T4,350-8); (2) L-phenyl alanine methyl ester hydrochloride $C_6H_5CH_2CH(NH_2)COOCH_3.HCl$ (Aldrich P1,720-2); (3)

D,L- 4-chlorophenylalanine methyl ester hydrochloride $ClC_6H_4CH_2CH(NH_2)COOCH_3.HCl$ (Aldrich 27,181-0); (4) ethyl 4-aminobenzoate hydrochloride $H_2NC_6H_4COOC_2H_5.HCl$ (Aldrich 29,366-0); (5) L-phenyl alanine ethyl ester hydrochloride $C_6H_5CH_2CH(NH_2)COOC_2H_5.HCl$ (Aldrich 22,070-1); (6) D,L- 4-chlorophenylalanine ethyl ester hydrochloride $ClC_6H_4CH_2CH(NH_2)COOC_2H_5.HCl$ (Aldrich 15,678-7); and the like.

Also suitable are (XII) acid salts of aromatic imines, such as (1) ephedrine hydrochloride $C_6H_5CH[CH(NHCH_3)CH_3]OH.HCl$ (Aldrich 28,574-9; 86,223-1); (2) ephedrine nitrate $C_6H_5CH[CH(NHCH_3)CH_3]OH.HNO_3$ (Aldrich 86,039-5); (3) (1S, 2S)-(+)-pseudoephedrine hydrochloride $C_6H_5CH[CH(NHCH_3)CH_3]OH.HCl$ (Aldrich 29,461-6); (4) (±) 4-hydroxyephedrine hydrochloride $HOC_6H_4CH(OH)CH(CH_3)NHCH_3.HCl$ (Aldrich 10,615-1); (5)(±)isoproternenol hydrochloride 3,4-$(HO)_2C_6H_3CH(OH)CH_2NHCH(CH_3)_2.HCl$ (Aldrich I-2, 790-2); (6) (±)-propranolol hydrochloride $C_{10}H_7OCH_2CH(OH)CH_2NHCH(CH_3)_2.HCl$ (Aldrich 22,298-4); (7) chlorohexidine diacetate hydrate $[—(CH_2)_3NHC{=}NH)NHC({=}NH)NHC_6H_4Cl]_2.2CH_3COOH.xH_2O$ (Aldrich 23,386-2); (8) (±)-2-(methyl amino) propiophenone hydrochloride $C_6H_5COCH(CH_3)NHCH_3.HCl$ (Aldrich 31,117-0); (9) 4-methyl aminophenol sulfate $(CH_3NHC_6H_4OH)_2.H_2SO_4$ (Aldrich 32,001-3); (10) methyl benzimidate hydrochloride $C_6H_5C({=}NH)OCH_3.HCl$ (Aldrich 22,051-5); (11) (±)-metanephrine hydrochloride $HOC_6H_3(OCH_3)CH(CH_2NHCH_3)OH.HCl$ (Aldrich 27,428-3); (12) malonaldehyde bis (phenyl imine) dihydrochloride $CH_2(CH{=}NC_6H_5)_2.2HCl$ (Aldrich 34, 114-2); (13) (±)-ketamine hydrochloride $ClC_6H_4C_6H_5({=}O)NHCH_3.HCl$ (Aldrich 34,309-9); (14) (±)-isoproterenol sulfate dihydrate $[3,4-(HO)_2C_6H_3CH(OH)CH_2NH(CH_3)_2]_2.H_2SO_4.2H_2O$ (Aldrich 10,044-7); (15) isoproterenol L-bitartrate $3,4-(HO)_2C_6H_3CH(OH)CH_2NH(CH_3)_2$ $HOOCCH(OH)CH(OH)COOH$ (Aldrich 18,881-6); (16) diphenyhydramine hydrochloride $(C_6H_5)_2CHOCH_2CH_2N(CH_3)_2.HCl$ (Aldrich 28,566-8); (17) 3-dimethylamino propiophenone hydrochloride $C_6H_5COCH_2CH_2N(CH_3)_2.HCl$ (Aldrich D14,480-0); (18) neostigmine bromide $3-[(CH_3)_2NCOO]C_6H_4N(CH_3)_3Br$ (Aldrich 28,679-6); (19) neostigmine methyl sulfate $3-[(CH_3)_2NCOO]C_6H_4N(CH_3)_3(OSO_3CH_3)$ (Aldrich 28,681-8); (20) orphenadrine hydrochloride $CH_3C_6H_4CH(C_6H_5)OCH_2CH_2N(CH_3)_2.HCl$ (Aldrich 13,128-8); and the like.

Examples of suitable quaternary choline halides include (1) choline chloride [(2-hydroxyethyl) trimethyl ammonium chloride] $HOCH_2CH_2N(CH_3)_3Cl$ (Aldrich 23,994-1) and choline iodide $HOCH_2CH_2N(CH_3)_3I$ (Aldrich C7,971-9); (2) acetyl choline chloride $CH_3COOCH_2CH_2N(CH_3)_3Cl$ (Aldrich 13,535-6), acetyl choline bromide $CH_3COOCH_2CH_2N(CH_3)_3Br$ (Aldrich 85,968-0), and acetyl choline iodide $CH_3COOCH_2CH_2N(CH_3)_3I$ (Aldrich 10,043-9); (3) acetyl-β-methyl choline chloride $CH_3COOCH(CH_3)CH_2N(CH_3)Cl$ (Aldrich A1,800-1) and acetyl-β-methyl choline bromide $CH_3COOCH(CH_3)CH_2N(CH_3)_3Br$ (Aldrich 85,554-5); (4) benzoyl choline chloride $C_6H_5COOCH_2CH_2N(CH_3)_3Cl$ (Aldrich 21,697-6); (5) carbamyl choline chloride $H_2NCOOCH_2CH_2N(CH_3)_3Cl$ (Aldrich C240-9); (6) D,L-carnitinamide hydrochloride $H_2NCOCH_2CH(OH)CH_2N(CH_3)_3Cl$ (Aldrich 24,783-9); (7) D,L-carnitine hydrochloride $HOOCCH_2CH(OH)CH_2N(CH_3)_3Cl$ (Aldrich C1,600-8); (8) (2-bromo ethyl) trimethyl ammonium chloride [bromo oholine chloride] $BrCH_2CH_2N(CH_3)_3Br$ (Aldrich 11,719-6); (9) (2-chloro ethyl) trimethyl ammonium chloride [chloro choline chloride) $ClCH_2CH_2N(CH_3)_3Cl$ (Aldrich 23,443-5); (10) (3-carboxy propyl) trimethyl ammonium chloride $HOOC(CH_2)_3N(CH_3)_3Cl$ (Aldrich 26,365-6); (11) butyryl choline chloride $CH_3CH_2CH_2COOCH_2CH_2N(CH_3)_3Cl$ (Aldrich 85,537-5); (12) butyryl thiocholine iodide $CH_3CH_2CH_2COSCH_2CH_2N(CH_3)_3I$ (Aldrich B 10,425-6); (13) S-propionyl thiocholine iodide $C_2H_5COSCH_2CH_2N(CH_3)I$ (Aldrich 10,412-4); (14) Soacetylthiocholine bromide $CH_3COSCH_2CH_2N(CH_3)_3Br$ (Aldrich 85,533-2) and S-acetylthiocholine iodide $CH_3COSCH_2CH_2N(CH_3)_3I$ (Aldrich A2,230-0); (15) suberyl dicholine dichloride $[—(CH_2)_3COOCH_2CH_2N(CH_3)_3Cl]_2$ (Aldrich 86,204-5) and suberyl dicholine diiodide $[—(CH_2)_3COOCH_2CH_2N(CH_3)_3I]_2$ (Aldrich 86,211-8); and the like, as well as mixtures thereof.

Also suitable as antistatic agents are pyrrole and pyrrolidine acid salt compounds, of the general formulae

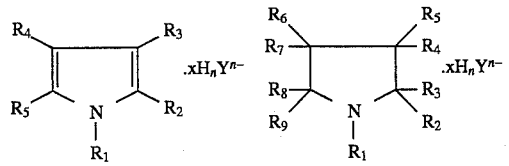

wherein $R_1$, $R_2$, $R_3$, $R_4$, $R_5$, $R_6$, $R_7$, $R_8$, and $R_9$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HHCOO^-$, $CH_3HCOO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable pyrrole and pyrrolidine acid salt compounds include (1) 1-amino pyrrolidine hydrochloride (Aldrich 12,310-2), of the formula:

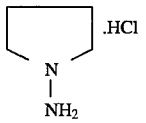

(2) 2-(2-chloroethyl)-1-methyl pyrrolidine hydrochloride (Aldrich 13,952-1), of the formula:

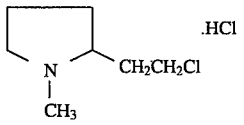

(3) 1-(2-chloroethyl) pyrrolidine hydrochloride (Aldrich C4,280-7), of the formula:

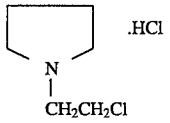

(4) L-proline methyl ester hydrochloride (Aldrich 28,706-7), of the formula:

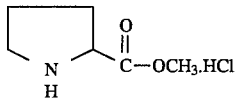

(5) tremorine dihydrochloride [1,1'-(2-butynylene) dipyrrolidine hydrochloride] (Aldrich T4,365-6), of the formula:

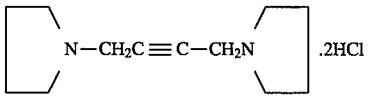

(6) ammonium pyrrolidine dithiocarbamate (Aldrich 14,269-7), of the formula:

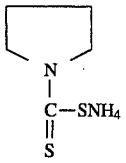

(7) pyrrolidone hydrotribromide (Aldrich 15,520-9), of the formula:

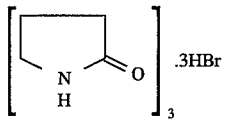

(8) 1-(4-chlorobenzyl)-2-(1-pyrrolidinyl methyl) benzimidazole hydrochloride (Aldrich 34,208-4), of the formula:

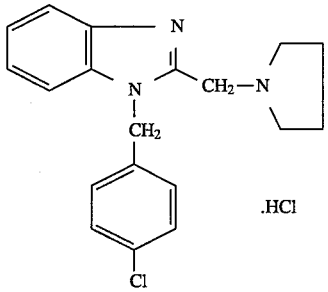

(9) billverdin dihydrochloride (Aldrich 25,824-5), of the formula:

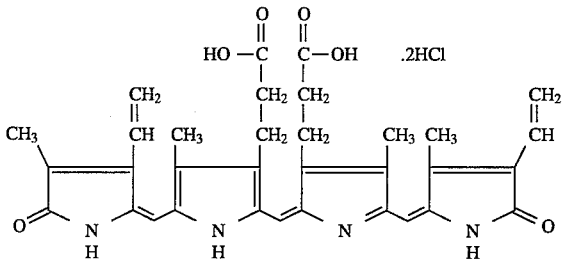

and the like.

Also suitable as antistatic agents are pyridine acid salt compounds, of the general formula

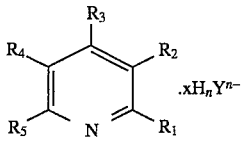

wherein $R_1$, $R_2$, $R_3$, $R_4$, and $R_5$ each, independently from one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, and $R_5$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable pyridine acid salt compounds include (1) pyridine hydrobromide (Aldrich 30,747-5), of the formula:

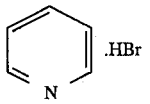

(2) pyridine hydrochloride (Aldrich 24,308-6), of the formula:

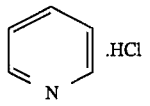

(3) 2-(chloromethyl) pyridine hydrochloride (Aldrich 16,270-1), of the formula:

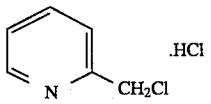

(4) 2-pyridylacetic acid hydrochloride (Aldrich P6,560-6), of the formula:

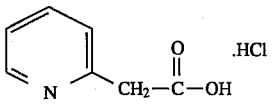

(5) nicotinoyl chloride hydrochloride (Aldrich 21,338-1), of the formula:

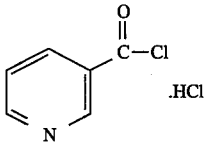

(6) 2-hydrazinopyridine dihydrochloride (Aldrich H1,710-4), of the formula:

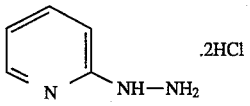

(7) 2-(2-methyl aminoethyl) pyridine dihydrochloride (Aldrich 15,517-9), of the formula:

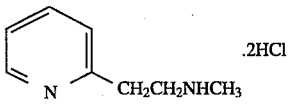

(8) 1-methyl-1,2,3,6-tetrahydropyridine hydrochloride (Aldrich 33,238-0), of the formula:

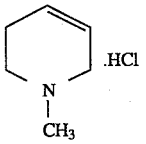

(9) 2,6-dihydroxypyridine hydrochloride (Aldrich D12,000-6), of the formula:

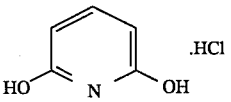

(10) 3-hydroxy-2(hydroxymethyl) pyridine hydrochloride (Aldrich H3,153-0), of the formula:

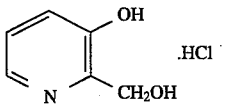

(11) pyridoxine hydrochloride (Aldrich 11,280-1), of the formula:

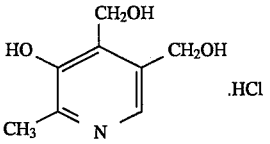

(12) pyridoxal hydrochloride (Aldrich 27,174-8), of the formula:

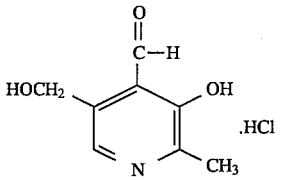

(13) pyridoxal 5-phosphate monohydrate (Aldrich 85,786-6), of the formula:

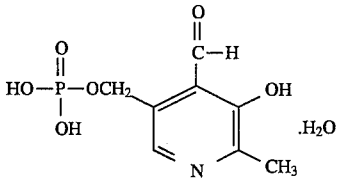

(14) 3-amino-2,6-dimethoxy pyridine hydrochloride (Aldrich 14,325-1), of the formula:

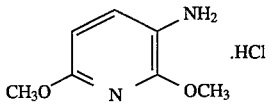

(15) pyridoxamine dihydrochloride monohydrate (Aldrich 28,709-1), of the formula:

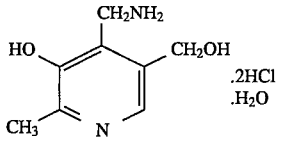

(16) iproniazid phosphate (isonicotinic acid 2-isopropyl hydrazide phosphate) (Aldrich I-1,265-4), of the formula:

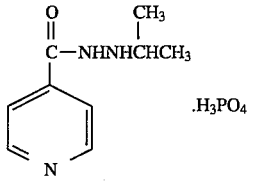

(17) tripelennamine hydrochloride (Aldrich 28,738-5), of the formula:

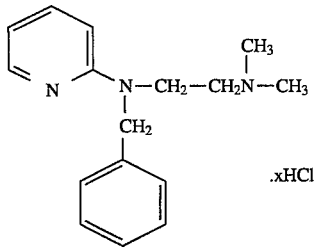

and the like.

Also suitable as antistatic agents are piperidine and homopiperidine acid salt compounds, of the general formulae

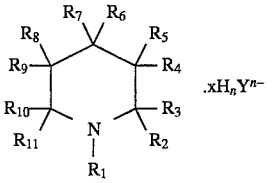

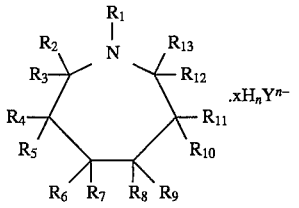

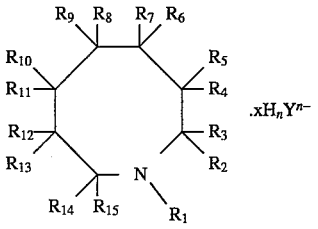

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, and $R_{15}$ each. independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, and $R_{15}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable piperidine and homopiperidine acid salts include (1) 2-(hexamethylene imino) ethyl chloride monohydrochloride (Aldrich H1,065-7), of the formula:

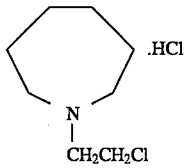

(2) 3-(hexahydro-1H-azepin-1-yl)-3'-nitropropiophenone hydrochloride (Aldrich 15,912-3), of the formula:

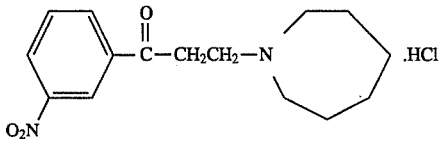

(3) imipramine hydrochloride [5-(3-dimethyl aminopropyl)-10,11-dihydro 5H-dibenz-(b,f) azepine hydrochloride] (Aldrich 28,626-5), of the formula:

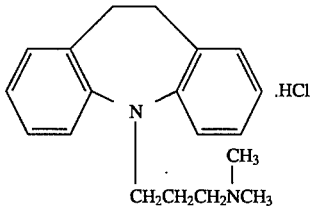

(4) carbamezepine [5H-dibenzo (b,f)-azepine-5-carboxamide] (Aldrich 30,948-6), of the formula:

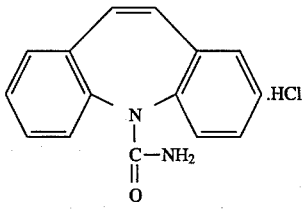

(5) 5,6,11,12-tetrahydro dibenz[b,f]azocine hydrochloride (Aldrich 18,761-5), of the formula:

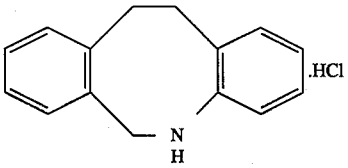

(6) 2-iminopiperidine hydrochloride (Aldrich 13,117-2), of the formula:

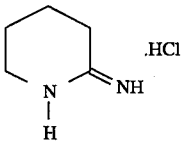

and the like.

Also suitable as antistatic agents are quinoline and isoquinoline acid salt compounds, of the general formulae:

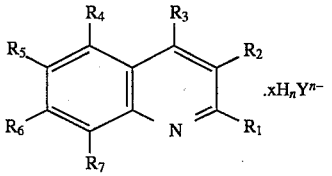

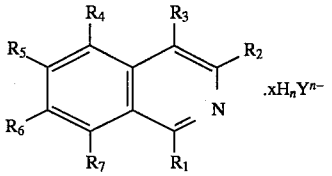

wherein $R_1$, $R_2$, $R_3$, $R_4$, $R_5$, $R_6$, and $R_7$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms. arylalkyl groups, preferably with from about 7 to about 31 carbon atoms and more preferably with from about 7 to about 20 carbon atoms. substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3HCOO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable quinoline and isoquinoline acid salt compounds include (1) 8-hydroxyquinoline hemisulfate hemihydrate (Aldrich 10,807-3), of the formula:

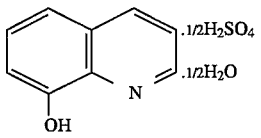

(2) 5-amino-8-hydroxy quinoline dihydrochloride (Aldrich 30,552-9), of the formula:

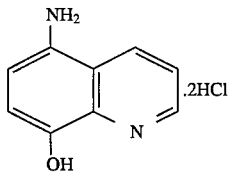

(3) 2-(chloromethyl) quinoline monohydrochloride (Aldrich C5,710-3), of the formula:

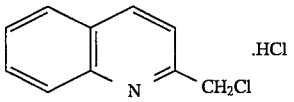

(4) 8-hydroxyquinoline-5-sulfonic acid monohydrate (Aldrich H5,875-7), of the formula:

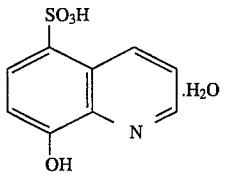

(5) 8-ethoxy-5-quinoline sulfonic acid sodium salt hydrate (Aldrich 17,346-0), of the formula:

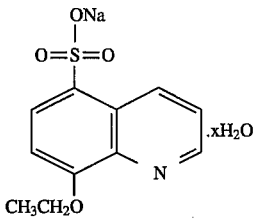

(6) 1,2,3,4-tetrahydroisoquinoline hydrochloride (Aldrich 30,754-8), of the formula:

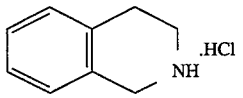

(7) 1,2,3,4-tetrahydro-3-isoquinoline carboxylic acid hydrochloride (Aldrich 21,493-0), of the formula:

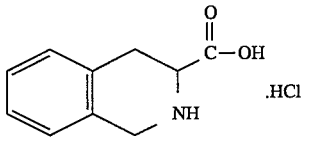

(8) 6,7-dimethoxy-1,2,3,4-tetrahydro isoquinoline hydrochloride (Aldrich 29,191-9), of the formula:

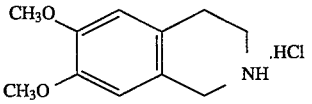

(9) 1-methyl-6,7-dihydroxy-1,2,3,4-tetrahydro isoquinoline hydrobromide (Aldrich 24,420-1), of the formula:

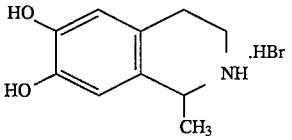

(10) primaquine diphosphate [8-(4-amino-1-methyl butyl amino)-6 -methoxy quinoline diphosphate] (Aldrich 16,039-3), of the formula:

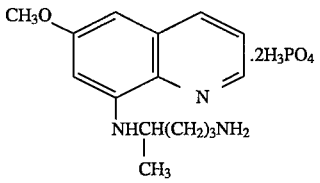

(11) pentaquine phosphate (Aldrich 30,207-4), of the formula:

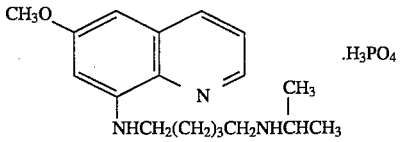

(12) dibucaine hydrochloride [2-butoxy-N-(2-diethyl amino ethyl)-4 -quinoline carboxamide hydrochloride] (Aldrich 28,555-2), of the formula:

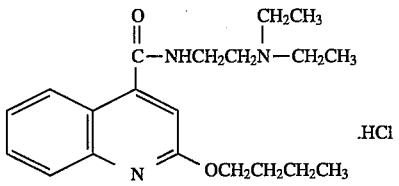

(13) 9-aminoacridine hydrochloride hemihydrate (Aldrich A3,840-1), of the formula:

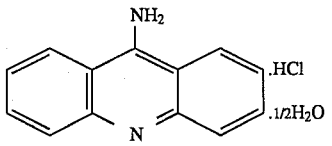

(14) 3,6-diamino acridine hemisulfate (Aldrich 19,822-6), of the formula:

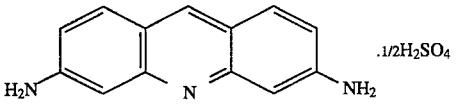

(15) 2-quinoline thiol hydrochloride (Aldrich 35,978-5),of the formula:

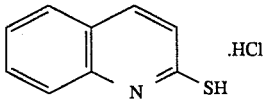

(16) (–) sparteine sulfate pentahydrate (Aldrich 23,466-4), of the formula:

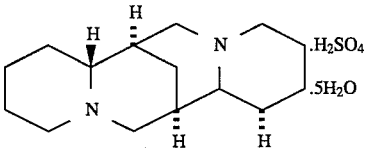

(17) papaverine hydrochloride (Aldrich 22,287-9), of the formula:

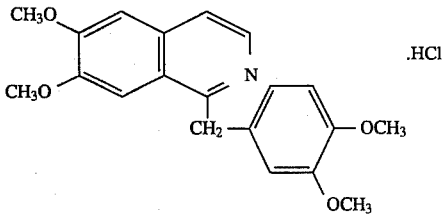

(18) (+)-emetine dihydrochloride hydrate (Aldrich 21,928-2), of the formula:

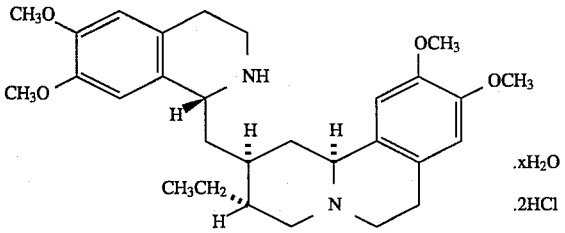

(19) 1,10-phenanthroline monohydrochloride monohydrate (Aldrich P1,300-2), of the formula:

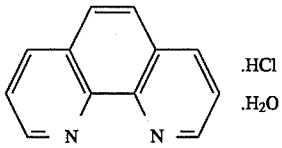

(20) neocuproine hydrochloride trihydrate (Aldrich 12,189-6), of the formula:

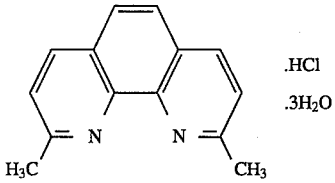

and the like.

Also suitable as antistatic agents are quinuclidine acid salt compounds, of the general formula

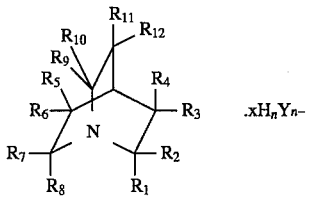

wherein $R_1$, $R_2$, $R_3$, $R_4$, $R_5$, $R_6$, $R_7$, $R_8$, $R_9$, $R_{10}$, $R_{11}$, and $R_{12}$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably With from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, and $R_{12}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, Icetone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable quinuclidine acid salt compounds include (1) quinuclidine hydrochloride (Aldrich 13,591-7), of the formula:

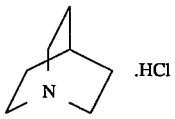

(2) 3-quinuclidinol hydrochloride (Aldrich Q188-3), of the formula:

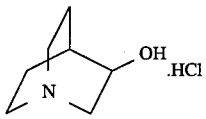

(3) 3-quinuclidinone hydrochloride (Aldrich Q190-5), of the formula:

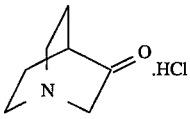

(4) 2-methylene-3-quinuclidinone dihydrate hydrochloride (Aldrich M4,612-8), of the formula:

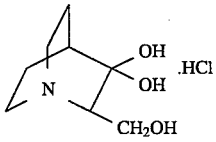

(5) 3-amino quinuclidine dihydrochloride (Aldrich 10,035-8), of the formula:

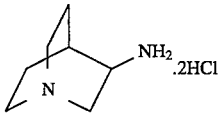

(6) 3-chloro quinuclidine hydrochloride (Aldrich 12,521-0), of the formula:

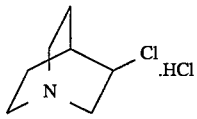

(7) quinidine sulfate dihydrate (Aldrich 14,589-0), of the formula:

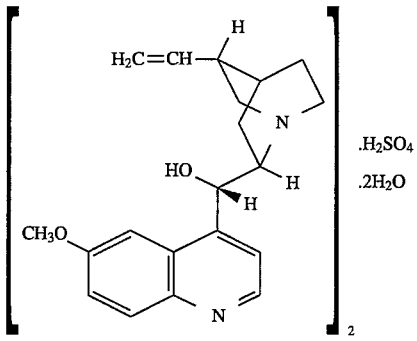

(8) quinine monohydrochloride dihydrate (Aldrich 14,592-0), of the formula:

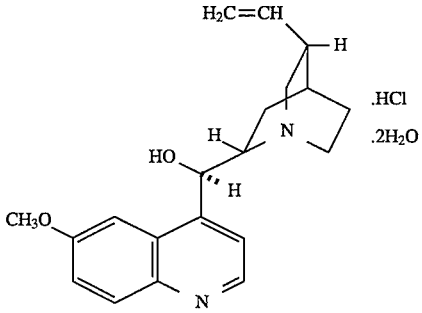

(9) quinine sulfate monohydrate (Aldrich 14,591-2), of the formula:

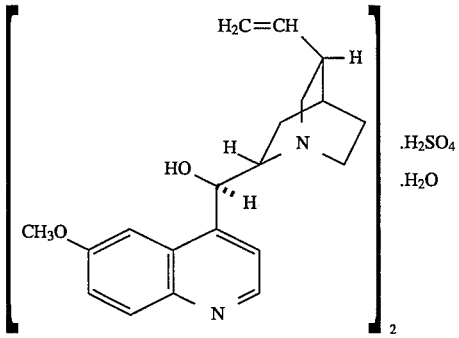

(10) hydroquinidine hydrochloride (Aldrich 25,481-9), of the formula:

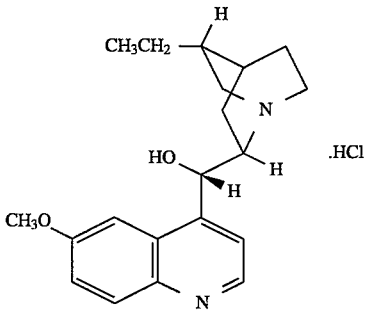

(11) hydroquinine hydrobromide dihydrate (Aldrich 34,132-0), of the formula:

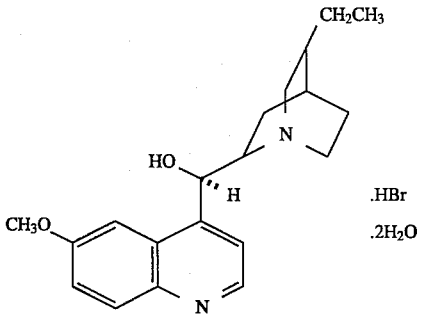

and the like.

Also suitable as antistatic agents are indole and indazole acid salt compounds, of the general formulae

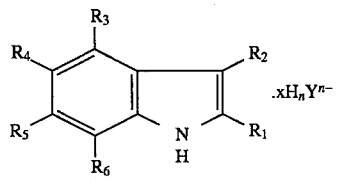

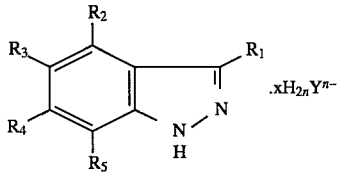

wherein $R_1$, $R_2$, $R_3$, $R_4$, $R_5$, and $R_6$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable indole and indazole acid salt compounds include (1) tryptamine hydrochloride (Aldrich 13,224-1), of the formula:

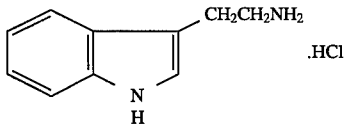

(2) 5-methyl tryptamine hydrochloride (Aldrich 13,422-8), of the formula:

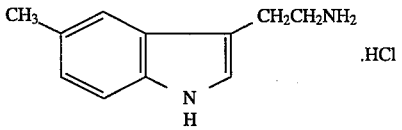

(3) serotonin hydrochloride hemihydrate (5-hydroxy tryptamine hydrochloride hemihydrate) (Aldrich 23,390-0), of the formula:

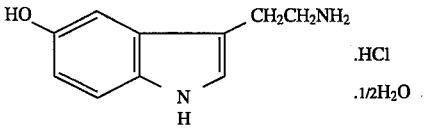

(4) norharman hydrochloride monohydrate (Aldrich 28,687-7), of the formula:

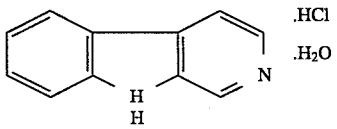

(5) harmane hydrochloride monohydrate (Aldrich 25,051-1), of the formula:

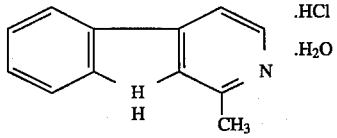

(6) harmine hydrochloride hydrate (Aldrich 12,848-1), of the formula:

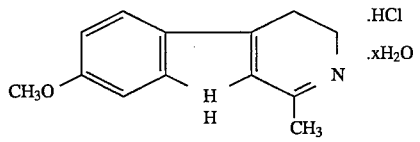

(7) harmaline hydrochloride dihydrate (Aldrich H10-9), of the formula:

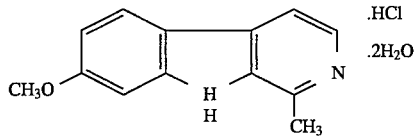

(8) harmol hydrochloride dihydrate (Aldrich 11,655-6), of the formula:

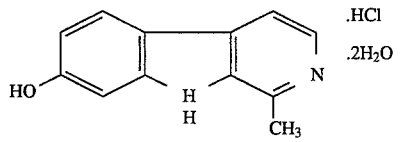

(9) harmalol hydrochloride dihydrate (Aldrich H12-5), of the formula:

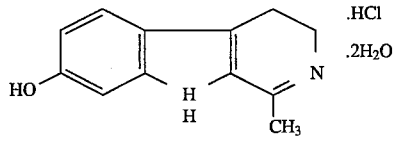

(10) 3,6-diamino acridine hydrochloride (Aldrich 13,110-5), of the formula:

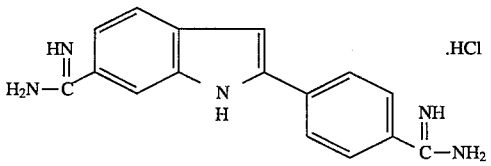

(11) S-(3-indolyl) isothiuronium iodide (Aldrich 16,097-0), of the formula:

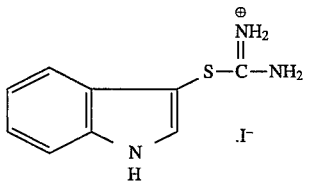

(12) yohimbine hydrochloride (Aldrich Y20-8), of the formula:

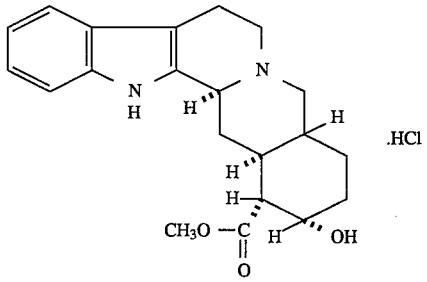

(13) 4,5-dihydro-3-(4-pyridinyl)-2H-benz[g]indazole methane sulfonate (Aldrich 21,413-2), of the formula:

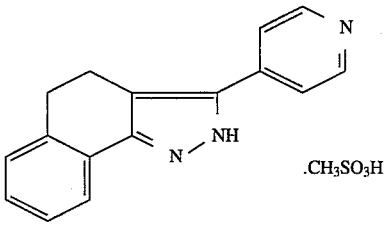

and the like.

Also suitable as antistatic agents are pyrimidine acid salt compounds, of the general formula

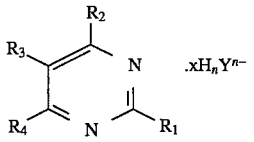

wherein $R_1$, $R_2$, $R_3$, and $R_4$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups. preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups. pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable pyrimidine acid salt compounds include (1) 2-hydroxypyrimidine hydrochloride (Aldrich H5,740-8), of the formula:

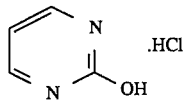

(2) 2-hydroxy-4-methyl pyrimidine hydrochloride (Aldrich H4,320-2), of the formula:

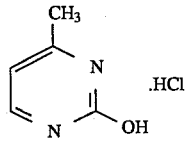

(3) 4,6-dimethyl-2-hydroxypyrimidine hydrochloride (Aldrich 33,996-2), of the formula:

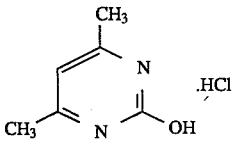

(4) 2-mercapto-4-methyl pyrimidine hydrochloride (Aldrich M480-5), of the formula:

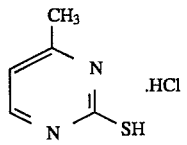

(5) 4,6-diamino pyrimidine hemisulfate monohydrate (Aldrich D2,480-3), of the formula:

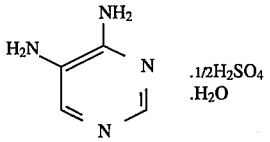

(6) 4,5,6-triamino pyrimidine sulfate hydrate (Aldrich T4,600-0; 30,718-1), of the formula:

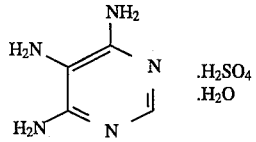

(7) 4,5-diamino-6-hydroxy pyrimidine sulfate (Aldrich D1,930-3), of the formula:

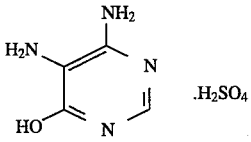

(8) 2,4-diamino-6-mercapto pyrimidine hemisulfate (Aldrich D1,996-6), of the formula:

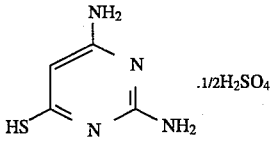

(9) 2,4-diamino-6-hydroxy pyrimidine hemisulfate hydrate (Aldrich 30,231-7), of the formula:

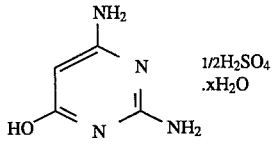

(10) 6-hydroxy-2,4,5-triamino pyrimidine sulfate (Aldrich H5,920-6), of the formula:

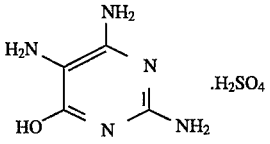

(11) 5,6-diamino-2,4-dihydroxy pyrimidine sulfate (Aldrich D1,510-3), of the formula:

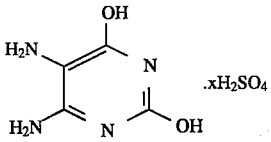

(12) $N^4$-(2-amino-4-pyrimidinyl) sulfanilamide monohydrochloride (Aldrich 15,237-4), of the formula:

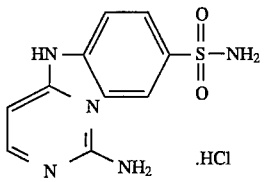

(13) 4,5,6-triamino-2(1H)-pyrimidinethione sulfate (Aldrich 26,096-7), of the formula:

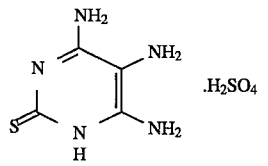

(14) 2,4,5,6-tetraamino pyrimidine sulfate (Aldrich T380-7), of the formula:

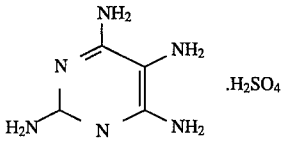

(15) (–)-cyclocytidine hydrochloride (Aldrich 85,883-8), of the formula:

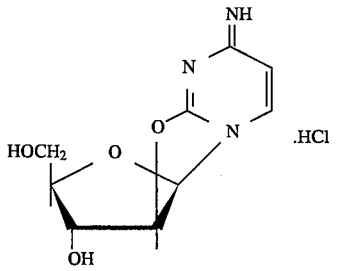

(16) cytosine arabinoside hydrochloride (Aldrich 85,585-5), of the formula:

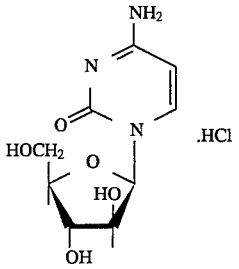

and the like.

Also suitable as antistatic agents are pyrazole acid salt compounds, of the general formula

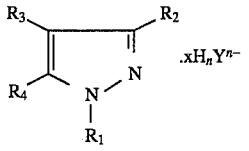

wherein $R_1$, $R_2$, $R_3$, and $R_4$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable pyrazole acid salt compounds include (1) 4-methyl pyrazole hydrochloride (Aldrich 28,667-2)

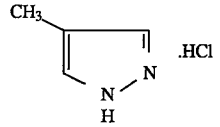

(2) 3,4-diamino-5-hydroxy pyrazole sulfate (Aldrich D1,900-1)

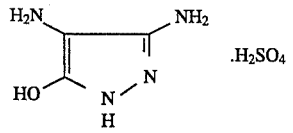

(3) (3,5-dimethyl pyrazole-1-carboxamidine nitrate) (Aldrich D18,225-7)

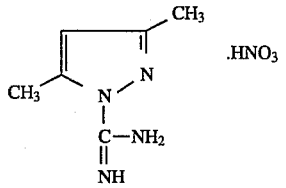

(4) 3-amino-4-pyrazole carboxamide hemisulfate (Aldrich 15,305-2)

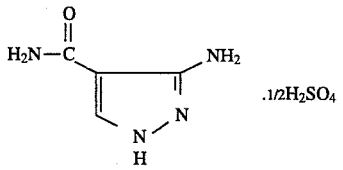

(5) acid salt of 6-amino indazole hydrochloride (Aldrich A5, 955-7)

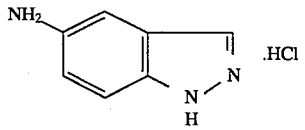

and the like.

Also suitable as antistatic agents are oxazole and isoxazole acid salt compounds, of the general formulae

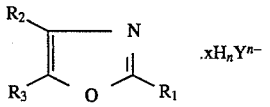

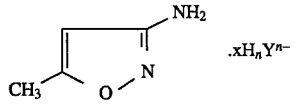

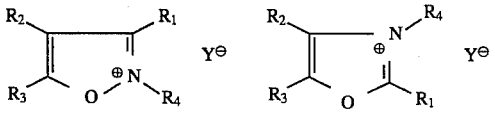

wherein $R_1$, $R_2$, $R_3$, and $R_4$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom such as carbon, oxygen, or the like. These compounds are in acid salt form wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable oxazole and isoxazole acid salt compounds include (1) 3,3'-dimethyl oxacarbocyanine iodide (Aldrich 32,069-2), of the formula:

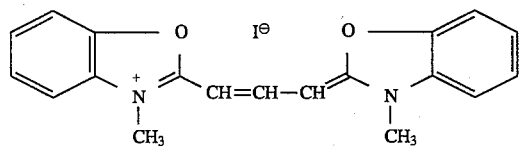

(2) 2-ethyl-5-phenyl isoxazolium-3'-sulfonate (Aldrich E4,526-0), of the formula:

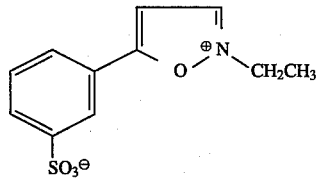

(3) 2-chloro-3-ethylbenzoxazolium tetrafluoroborate (Aldrich 23,255-6), of the formula:

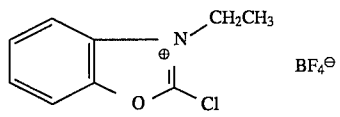

(4) 2-tert-butyl-5-methyl isoxazolium perchlorate (Aldrich B9,695-3), of the formula:

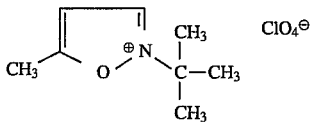

(5) 5-phenyl-2-(4-pyridyl) oxazole hydrochloride hydrate (Aldrich 23,748-5), of the formula:

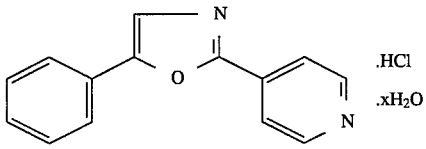

(6) 5-phenyl-2-(4-pyridyl) oxazole methyl tosylate salt (Aldrich 23,749-3), of the formula:

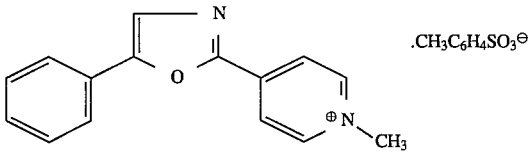

and the like.

Also suitable as antistatic agents are morpholine acid salt compounds, of the general formula

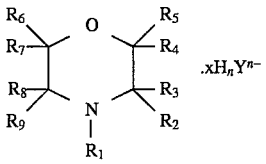

wherein $R_1$, $R_2$, $R_3$, $R_4$, $R_5$, $R_6$, $R_7$, $R_8$, and $R_9$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, Icetone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, Icetone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable morpholine acid salt compounds include (1) 4-(2-chloroethyl) morpholine hydrochloride (Aldrich C4,220-3), of the formula:

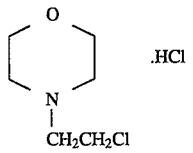

(2) 4-morpholine ethane sulfonic acid (Aldrich 16,373-2), of the formula:

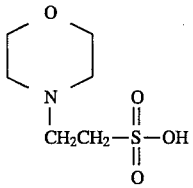

(3) 4-morpholine propane sulfonic acid (Aldrich 16,377-5), of the formula:

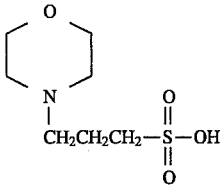

(4) β-hydroxy morpholine propane sulfonic acid (Aldrich 28,481-5), of the formula:

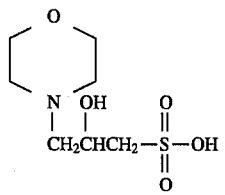

(5) [N-(aminoiminomethyl)-4-morpholine carboximidamide]hydrochloride (Aldrich 27,861-0), of the formula:

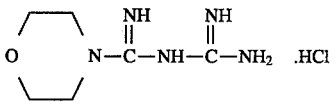

(6) 4-morpholine carbodithioic acid compound with morpholine (Aldrich 32,318-7), of the formula:

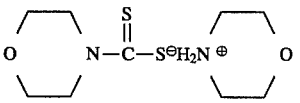

(7) 2,5-dimethyl-4-(morpholinomethyl)phenol hydrochloride monohydrate (Aldrich 18,671-6), of the formula:

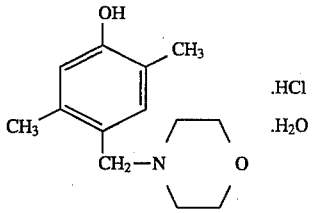

(8) 2-methoxy-4-morpholino benzene diazonium chloride, zinc chloride (Aldrich M1,680-6), of the formula:

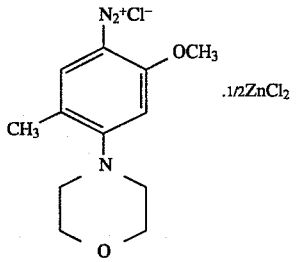

(9) 1-cyclohexyl-3-(2-morpholinoethyl) carbodiimide metho-p-toluene sulfonate (Aldrich C10,640-2), of the formula:

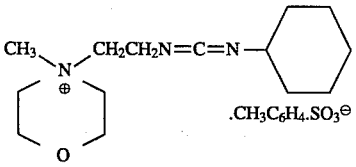

(10) hemicholinium-3[2,2'-(4,4'-biphenylene) bis(2-hydroxy-4,4-dimethyl morpholinium bromide) (Aldrich H30, 3), of the formula:

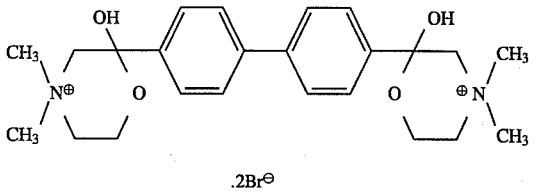

(11) hemicholinium-15[4,4-dimethyl-2-hydroxy-2-phenyl morpholinium bromide] (Aldrich 11,603-3), of the formula:

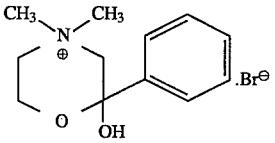

and the like.

Also suitable as antistatic agents are thiazole, thiazolidine, and thiadiazole acid salt compounds, of the general formulae

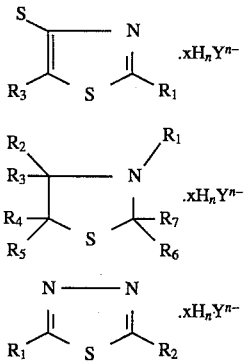

wherein $R_1$, $R_2$, $R_3$, $R_4$, $R_5$, $R_6$, and $R_7$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, Icetone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, Icetone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable thiazole, thiazolidine, and thiadiazole acid salt compounds include (1) 2-amino-4,5-dimethyl thiazole hydrochloride (Aldrich 17,440-8), of the formula:

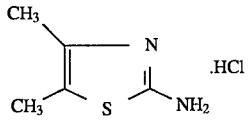

(2) 2-amino 4-imino-2-thiazoline hydrochloride (Aldrich 13,318-3), of the formula:

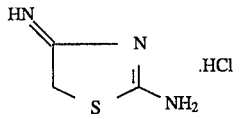

(3) 2-amino-2-thiazoline hydrochloride (Aldrich 26,372-9), of the formula:

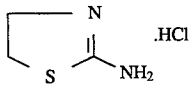

(4) 2-amino-5-bromothiazole monohydrobromide (Aldrich 12,802-3), of the formula:

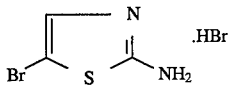

(5) 5-amino-3-methyl isothiazole hydrochloride (Aldrich 15,564-0), of the formula:

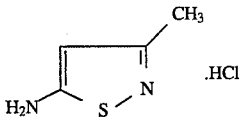

(6) 2,2,5,5-tetramethyl-4-thiazolidine carboxylic acid hydrochloride hemihydrate (Aldrich P100-4), of the formula:

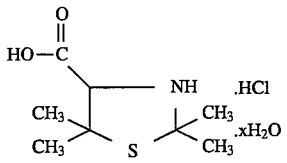

(7) 3-methyl-2-benzothiazolinone hydrazone hydrochloride hydrate (Aldrich 12,973-9), of the formula:

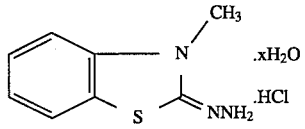

(8) 5-amino-2-methylbenzothiazole dihydrochloride (Aldrich A6,330-9), of the formula:

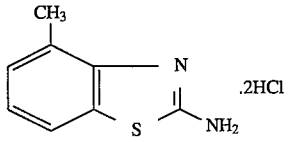

(9) 2,4-diamino-5-phenyl thiazole monohydrobromide (Aldrich D2,320-3), of the formula:

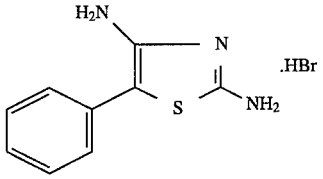

(10) 2-amino-4-phenyl thiazole hydrobromide monohydrate (Aldrich A7,500-5), of the formula:

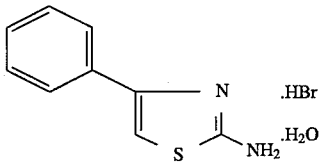

(11) 2-(tritylamino)-α-(methoxylmino)-4-thiazole acetic acid hydrochloride (Aldrich 28,018-6), of the formula:

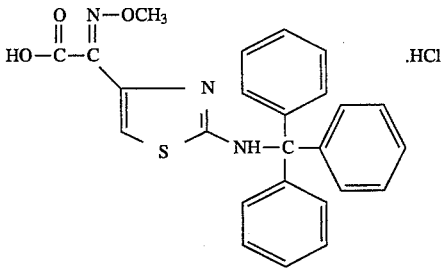

(12) (2,3,5,6-tetrahydro-6-phenylimidazo[2,1-b]thiazole hydrochloride (Aldrich 19,613-4; 19614-2), of the formula:

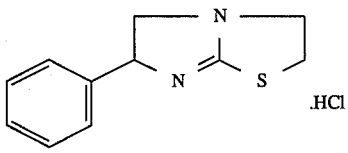

and the like.

Also suitable as antistatic agents are phenothiazine acid salt compounds, of the general formula

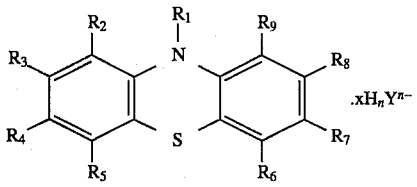

wherein $R_1$, $R_2$, $R_3$, $R_4$, $R_5$, $R_6$, $R_7$, $R_8$, and $R_9$ each, independently of one another, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, and $R_9$ can be joined together to form a ring, and wherein the substituents on the substituted alkyl groups, substituted aryl groups, and substituted arylalkyl groups can be (but are not limited hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, or the like. These compounds are in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like. Examples of suitable phenothiazine acid salt compounds include (1) trifluoroperazine dihydrochloride (Aldrich 28,388-6), of the formula:

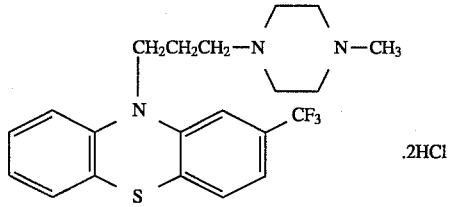

(2) thioridazine hydrochloride (Aldrich 25,770-2), of the formula:

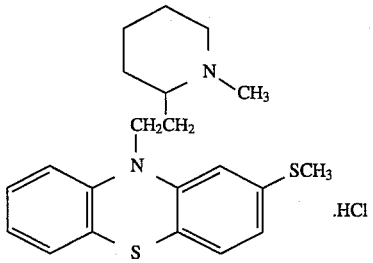

(3) (±)-promethazine hydrochloride (Aldrich 28,411-4), of the formula:

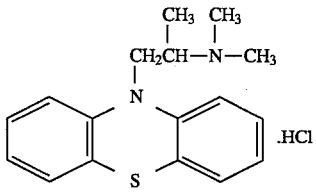

(4) ethopropazine hydrochloride (Aldrich 28,583-8), of the formula:

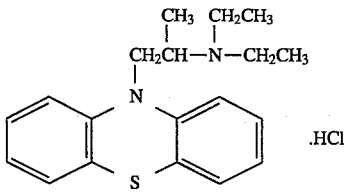

(5) chlorpromazine hydrochloride (Aldrich 28,537-4), of the formula:

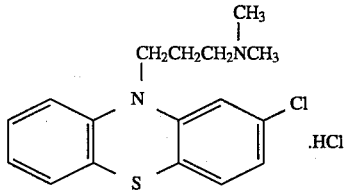

and the like.

Preferred antistatic agents are monomeric, although dimeric, trimeric, oligomeric, and polymeric antistatic agents can also be employed.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Migration imaging members were prepared as follows. A solution for the softenable layer was prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution was coated by a solvent extrusion technique onto 3 rail thick polyester substrates (Melinex 442, obtained from Imperial Chemical Industries (ICI), aluminized to 50 percent light transmission), and the deposited softenable layers were allowed to dry at about 115° C. for about 2 minutes, resulting in dried softenable layers with thicknesses of about 4 microns. The temperature of the softenable layers was then raised to about 115° C. to lower the viscosity of the exposed surfaces of the softenable layers to about $5\times10^3$ poises in preparation for the deposition of marking material. Thin layers of particulate vitreous selenium were then applied by vacuum deposition in a vacuum chamber maintained at a vacuum of about $4\times10^{-4}$ Torr. The imaging members were then rapidly chilled to room temperature. Reddish monolayers of selenium particles having an average diameter of about 0.3 micron embedded about 0.05 to 0.1 micron below the surfaces of the copolymer layers were formed.

Solutions were prepared of various binders and antistatic agents as shown in the table below. All solutions were in water and contained 5 percent by weight solids, wherein the solids portion contained 10 percent by weight of the antistatic agent and 90 percent by weight of the binder. The various antistatic coatings were coated onto the substrates of the migration imaging members (coated onto the surface opposite to that coated with the softenable layer) by a slot extrusion process and air dried at 100° C. to form antistatic layers 5 micron thick.

The charging and discharging characteristics of the antistatic layers on the imaging members thus formed were measured with a Static Charge Analyzer (Model 276A, obtained from Princeton Electro Dynamics) by applying charge for 5 seconds, maintaining the charge for 5 additional seconds, measuring the maximum voltage obtained in the coating, thereafter removing the charge source for an additional 5 seconds to allow discharge to occur, and again measuring the residual voltage in the coating after discharge. The results were as follows:

| | | | Voltage | |
|---|---|---|---|---|
| No. | Antistatic Agent | Binder | Maximum (charging) | Minimum (discharging) |
| 1 | 2-iminopiperidine hydrochloride (Aldrich 13,117-2) | hydroxypropyl methyl cellulose (HPMC K35LV, Dow Chemical) | 40 | 0 |
| 2 | 1,6-diamine hexane dihydrochloride (Aldrich 24,713-1) | hydroxypropyl methyl cellulose (HPMC K35LV, Dow Chemical) | 80 | 0 |
| 3 | benzyl amine hydrochloride (Aldrich 21,425-6) | 1 part by weight hydroxypropyl methyl cellulose (HPMC K35LV, Dow Chemical); 1 part by weight acrylic latex (InterPol HX42-1) | 20 | 0 |
| 4 | 3-chloro quinuclidine hydrochloride (Aldrich 12,521-0) | hydroxypropyl methyl cellulose (HPMC K35LV, Dow Chemical) | 240 | 0 |
| 5 | triethanol amine hydrochloride (Aldrich 15,891-7) | hydroxypropyl methyl cellulose (HPMC K35LV, Dow Chemical) | 620 | 0 |
| 6 | none | none | 1350 | 1350 |

As the results indicate, the bottom surfaces of the imaging members having antistatic coatings acquired a significantly lower maximum charge than those of the uncoated imaging members, and after discharge the coated imaging members had zero residual charge, whereas the uncoated imaging member retained its maximum charge.

Other embodiments and modifications of the present invention may occur to those skilled in the art subsequent to a review of the information presented herein; these embodiments and modifications, as well as equivalents thereof, are also included within the scope of this invention.

What is claimed is:

1. A migration imaging member comprising (a) a substrate, (b) a softenable layer situated on one surface of the substrate, said softenable layer comprising a softenable material and a photosensitive migration marking material, and (c) an antistatic layer situated on the surface of the substrate opposite to the surface in contact with the softenable layer, said antistatic layer containing an antistatic agent selected from the group consisting of amine acid salt compounds, pyrrole acid salt compounds, pyrrolidine acid salt compounds, pyridine acid salt compounds, piperidine acid salt compounds, homopiperidine acid salt compounds, quinoline acid salt compounds, isoquinoline acid salt compounds, quinuclidine acid salt compounds, indole acid salt compounds, indazole acid salt compounds, pyrimidine acid salt compounds, pyrazole acid salt compounds, oxazole acid salt compounds, isoxazole acid salt compounds, morpholine acid salt compounds, thiazole acid salt compounds, thiazolidine acid salt compounds, thiadiazole acid salt compounds, phenothiazine acid salt compounds, and mixtures thereof.

2. A migration imaging member according to claim 1 wherein the substrate comprises a polyester having an electrically conductive coating thereon.

3. A migration imaging member according to claim 1 also comprising an overcoating layer situated on the surface of the softenable layer spaced from the substrate.

4. A migration imaging member according to claim 1 wherein a charge transport material is present in the softenable layer.

5. A migration imaging member according to claim 1 wherein the antistatic layer has a thickness of from about 0.5 to about 25 microns.

6. A migration imaging member according to claim 1 wherein the antistatic layer has a thickness of from about 1 to about 3 microns.

7. A migration imaging member according to claim 1 wherein the antistatic layer comprises a binder and an antistatic agent.

8. A migration imaging member according to claim 7 wherein the binder is present in an amount of from about 50 to about 95 percent by weight and the antistatic agent is present in an amount of from about 5 to about 50 percent by weight.

9. A migration imaging member according to claim 7 wherein the binder is selected from the group consisting of (a) polysaccharides and their modifications; (b) vinyl polymers; (c) formaldehyde resins; (d) ionic polymers; (e) latex polymers; (f) maleic anhydride and maleic acid containing polymers; (g) acrylamide containing polymers; (h) poly (ethylene imine) containing polymers; and mixtures thereof.

10. A migration imaging member according to claim 7 wherein the binder is selected from the group consisting of (1) starch, (2) cationic starch, (3) hydroxyalkylstarches, (4) gelatin, (5) alkyl celluloses and aryl celluloses, (6) hydroxy alkyl celluloses, (7) alkyl hydroxy alkyl celluloses, (8) hydroxy alkyl alkyl celluloses, (9) dihydroxyalkyl celluloses, (10) hydroxyalkyl hydroxy alkyl celluloses, (11) chlorodeoxycellulose, (12) amino deoxycellulose, (13) dialkylammonium halide hydroxy alkyl celluloses, (14) hydroxyalkyl trialkyl ammonium halide hydroxyalkyl celluloses, (15) dialkyl amino alkyl celluloses, (16) carboxyalkyl dextrans, (17) dialkyl aminoalkyl dextrans, (18) amino dextran, (19) carboxy alkyl cellulose salts, (20) gum arabic, (21) carrageenan, (22) Karaya gum, (23) xanthan, (24) chitosan, (25) carboxyalkyl hydroxyalkyl guars, (26) cationic guars, (27) n-carboxyalkyl chitins, (28) dialkyl ammonium hydrolyzed collagen proteins, (29) agaragar, (30) cellulose sulfate salts, (31) carboxyalkylhydroxyalkyl cellulose salts, (32) poly(vinyl alcohol), (33) poly (vinyl phosphate), (34) poly (vinyl pyrrolidone), (35) vinyl pyrrolidone-vinyl acetate copolymers, (36) vinyl pyrrolidone-styrene copolymers, (37) poly (vinylamine), (38) poly (vinyl alcohol) alkoxylated, (39) poly (vinyl pyrrolidone-dialkylaminoalkyl alkylacrylates), (40) melamine-formaldehyde resin, (41) urea-formaldehyde resin, (42) alkylated urea-formaldehyde resins, (43) poly (2-acrylamide-2-methyl propane sulfonic acid), (44) poly (N,N-dimethyl-3,5-dimethylene piperidinium chloride), (45) poly (methylene-guanidine) hydrochloride, (46) cationic styrene-butadiene latexes, (47) anionic styrene-butadiene latexes, (48) nonionic styrene-butadiene latexes, (49) ethylene-vinylacetate latexes, (50) vinyl acetate-acrylic copolymer latexes, (51) styrene-maleic anhydride copolymers, (52) vinyl alkyl ether-maleic anhydride copolymers, (53) alkylene-maleic anhydride copolymers, (54) butadiene-maleic acid copolymers, (55) vinylalkylether-maleic acid copolymers, (56) alkyl vinyl ether-maleic acid esters, (57) poly (acrylamide), (58) acrylamide-acrylic acid copolymers, (59) poly (N,N-dimethyl acrylamide), (60) poly(ethylene imine), (61) poly(ethylene imine) epichlorohydrin, (62) alkoxylated poly (ethylene imine), (63) quaternary acrylic copolymer latexes, and (64) mixtures thereof.

11. A migration imaging member according to claim 1 wherein the antistatic agent is selected from the group consisting of amine acid salts.

12. A migration imaging member according to claim 1 wherein the antistatic agent is selected from the group consisting of guanidine acid salts, amino guanidine acid salts, 1,3-diamino guanidine acid salts, N-guanyl urea acid salts, (4-amino butyl) guanidine acid salts, malonamamidine acid salts, ethylene diamine acid salts, 1,3-diaminopropane acid salts, 1,4-diamino butane acid salts, 1,5-diamino pentane acid salts, 1,6-diamine hexane acid salts, triethylene tetramine acid salts, spermine acid salts, spermidine acid salts, cystamine acid salts, 2,2'-oxybis (ethylamine) acid salts, glycinamide acid salts, 1,3-diamino acetone acid salts, urea acid salts, 2,2-dimethyl-1,3-propane diamine acid salts, 1,4-diamino-2-butanone acid salts, leucinamide acid salts, (2-aminoethyl) trimethyl ammonium acid salts, formamidine acid salts, acetamidine acid salts, 2-ethyl-2-thiopseudo urea acid salts, guanidine acid salts, 1,1-dimethyl biguanide acid salts, methyl guanidine acid salts, ethyl guanidine acid salts, dodecyl guanidine acid salts, 1-(2,2-diethoxyethyl) guanidine acid salts, methyl glyoxal bis (guanyl hydrazone) acid salts, 2-methyl-2-thiopseudourea acid salts, o-methyl isourea acid salts, S,S'-(1,3-propanediyl) bis (isothiouronium) acid salts, methyl amine acid salts, ethyl amine acid salts, 3-chloropropylamine acid salts, aminomethyl cyclopropane acid salts, 2-methyl allyl amine acid salts, amino acetonitrile acid salts, amino acetonitrile acid salts, tert-butyl hydrazine acid salts, methoxyl amine acid salts, ethanol amine acid salts, O-(tert butyl) hydroxylamine acid salts, 6-amino-2-methyl-2-heptanol acid salts, o-allyl hydroxyl amine acid salts, hydroxylamine acid salts, serinol acid salts, 2-(ethylthio) ethylamine acid salts, o-ethyl hydroxylamine acid salts, tris (hydroxymethyl) aminomethane acid salts, octadecylamine acid salts, 2-aminoethyl acid salts, 2-bromoethylamine acid salts, glycine methylester acid salts, methionine methyl ester acid salts,) alanine methyl ester acid salts, leucine methyl ester acid salts, glycine ethyl ester acid salts, β-alanine ethyl ester acid salts, ethyl 4-aminobutyrate acid salts, alanine ethyl ester acid salts, methionine ethyl ester acid salts, glycine tert butyl ester acid salts, valine ethyl ester acid salts, valine methylester acid salts, N-α-acetylysine methylester acid salts, methyl 5-aminolevulinate acid salts, dimethylamine acid salts, diethyl amine acid salts, N-propylcyclopropane methyl amine acid salts, isopropyl formimidate acid salts, N-isopropyl hydroxylamine acid salts, N-(tert butyl) hydroxylamine acid salts, dimethyl suberimidate acid salts, N-methylhydroxylamine acid salts, methyl amino acetonitrile acid salts, N-cyclohexyl hydroxylamine acid salts, dimethyl adipimidate acid salts, trimethylamine acid salts, triethylamine acid salts, triethanol amine acid salts, 2-dimethyl amino isopropyl chloride acid salts, 2-dimethyl amino ethyl chloride acid salts, 3-dimethyl amino-2-methyl propyl chloride acid salts, 2-dimethyl aminoethanethiol acid salts, N,N-dimethyl glycine acid salts, 4-(dimethyl amino) butyric acid acid salts, N,N-dimethyl hydroxylamine acid salts, N,O-dimethyl hydroxylamine acid salts, 3-[bis(2-hydroxyethyl) amino]-2-hydroxy-1-propane acid salts, 2, 3-bis(hydroxyamino)-2,3-dimethyl butane acid salts, N,N-bis (2-hydroxyethyl)-2-amino ethane acid salts, α-amino-γ-butyrolactone acid salts, homocysteine thiolactone acid salts, endo-2-aminonorbornane acid salts, N-ethyl-3-phenyl-2-norbornanamine acid salts, 1-adamantanamine acid salts, 1,3-adamantane diamine acid salts, 3-noradamantanamine acid salts, 9-aminofluorene acid salts, octopamine acid salts, norphenylephrine acid salts, norephedrine acid salts, norepinephrine acid salts, norpseudoephedrine acid salts, α-(1-aminoethyl)-4-hydroxybenzyl alcohol acid salts, 2[2-(aminomethyl)phenylthio]benzylalcohol acid salts, 1-amino- 2-naphthol acid salts, 4-amino-1-naphthol acid salts, tyramine acid salts, tyrosine acid salts, O-methyldopamine acid salts, hydroxy dopamine acid salts, 3-hydroxytyramine acid salts, o-benzyl hydroxyl amine acid salts, aminomethyl-1-cyclohexanol acid salts, 2-amino cyclohexanol acid salts, 4-amino-2,3-dimethyl phenol acid salts, 4-(2-hydroxyethylthio)1-3-phenylenediamine acid salts, 2-amino-3-hydroxy benzoic acid acid salts, 4 -hydroxy-3-methoxy benzyl amine acid salts, 4-amino phenol acid salts, 2-[2-(aminomethyl)phenyl thio]benzyl alcohol acid salts, amino diphenyl methane acid salts, (4-aminophenyl) trimethyl ammonium acid salts, 4 -aminoantipyrine acid salts, tolylhydrazine acid salts, 3-chloro-p-tolyl hydrazine acid salts, 4-chloro-o-tolylhydrazine acid salts, chlorophenyl hydrazine acid salts, 3-nitrophenyl hydrazine acid salts, 4-isopropyl phenylhydrazine acid salts, dimethyl phenyl hydrazine acid salts, 1,1-diphenyl hydrazine acid salts, 3-hydroxybenzyl hydrazine acid salts, phenylene diamine acid salts, N,N-dimethyl-1,3-phenylene diamine acid salts, N,N-dimethyl-1,4-phenylene diamine acid salts, 4,4'-diamino diphenylamine acid salts, N,N-diethyl-1,4-phenylene diamine acid salts, 2,4-diamino phenol acid salts, 4-(dimethyl amino) benzyl amine acid salts, 3,3'-dimethoxy benzidine acid salts, 4,4'-diaminostilbene acid salts, 4-(aminomethyl)benzene sulfonamide acid salts, 4-methoxy-1,2-phenylene diamine acid salts, procaine acid salts, procain amide acid salts, 3,3',5,5'-tetramethyl benzidine acid salts, N-(1-naphthyl) ethylene diamine acid salts, alanine-2-naphthylamide acid salts, N-(4-methoxyphenyl)-1,4-phenylene diamine acid salts, 2-methoxy-1,4-phenylene diamine acid salts, 2,2 -dimethyl,-1,3-propane diamine acid salts, benzamidine acid salts, 4-amidino benzamide acid salts, 3-aminobenzamidine acid salts, 4-aminobenzamidine acid salts, 1-(3-phenyl propyl amino) guanidine acid salts, 2-benzyl-2 -thiopseudourea acid salts, 2-phenyl cyclopropyl amine acid salts, amino diphenyl methane acid salts, 2-phenyl glycine acid salts, phenethylamine acid salts, 2,4-dimethoxybenzylamine acid salts, 3,4-dibenzyloxy phenethyl amine acid salts, 2,2-diphenyl propylamine acid salts, 2,4,6-trimethoxy benzylamine acid salts, 4-benzyloxyaniline acid salts, benzylamine acid salts, N-α-p-tosyl-arginine methylester acid salts, phenyl alanine methyl ester acid salts, 4-chlorophenylalanine methyl ester acid salts, ethyl 4-aminobenzoate acid salts, phenyl alanine ethyl ester acid salts, 4-chlorophenylalanine ethyl ester acid salts, ephedrine acid salts, pseudoephedrine acid salts, 4-hydroxyephedrine acid salts, isoproternenol acid salts, propranolol acid salts, chlorohexidine acid salts, 2-(methyl amino) propiophenone acid salts, 4-methyl aminophenol acid salts, methyl benzimidate acid salts, metanephrine acid salts, malonaldehyde bis(phenyl imine) acid salts, ketamine acid salts, isoproterenol acid salts, diphenyhydramine acid salts, 3-dimethylamino propiophenone acid salts, neostigmine acid salts, orphenadrine acid salts, and mixtures thereof.

13. A migration imaging member comprising (a) a substrate, (b) a softenable layer situated on one surface of the substrate, said softenable layer comprising a softenable material and a photosensitive migration marking material, and (c) an antistatic layer situated on the surface of the substrate opposite to the surface in contact with the softenable layer, said antistatic layer containing an antistatic agent selected from the group consisting of quaternary choline halides.

14. A migration imaging member according to claim 13 wherein the antistatic agent is selected from the group consisting of (1) choline halides; (2) acetyl choline halides; (3) acetyl-β-methyl choline halides; (4) benzoyl choline halides; (5) carbamyl choline halides; (6) carnitinamide hydrohalides; (7) carnitine hydrohalides; (8) (2-bromo ethyl) trimethyl ammonium halides; (9) (2-chloro ethyl) trimethyl ammonium halides; (10) (3-carboxy propyl) trimethyl ammonium halides; (11) butyryl choline halides; (12) butyryl thiocholine halides; (13) S-propionyl thiocholine halides; (14) S-acetylthiocholine halides; (15) suberyl dicholine dihalides; and (16) mixtures thereof.

15. A migration imaging member according to claim 1 wherein the antistatic agent is selected from the group consisting of pyrrole acid salt compounds and pyrrolidine acid salt compounds.

16. A migration imaging member according to claim 1 wherein the antistatic agent is selected from the group consisting of (1) 1-amino pyrrolidine acid salts; (2) 2-(2-chloroethyl)-1-methyl pyrrolidine acid salts; (3) 1-(2-chloroethyl) pyrrolidine acid salts; (4) proline methyl ester acid salts; (5) tremorine acid salts; (6) ammonium pyrrolidine acid salts; (7) pyrrolidone acid salts; (8) 1-(4-chlorobenzyl)-2-(1-pyrrolidinyl methyl) benzimidazole acid salts; (9) billverdin acid salts; and (10) mixtures thereof.

17. A migration imaging member according to claim 1 wherein the antistatic agent is selected from the group consisting of pyridine acid salt compounds.

18. A migration imaging member according to claim 1 wherein the antistatic agent is selected from the group consisting of (1) pyridine acid salts; (2) 2-(chloromethyl) pyridine acid salts; (3) 2-pyridylacetic acid acid salts; (4) nicotinoyl chloride acid salts; (5) 2-hydrazinopyridine acid salts; (6) 2-(2-methyl aminoethyl) pyridine acid salts; (7) 1-methyl-1,2,3,6-tetrahydropyridine acid salts; (8) 2,6-dihydroxypyridine acid salts; (9) 3-hydroxy-2(hydroxymethyl) pyridine acid salts; (10) pyridoxine acid salts; (11) pyridoxal acid salts; (12) pyridoxal 5-phosphate acid salts; (13) 3-amino- 2,6-dimethoxy pyridine acid salts; (14) pyridoxamine acid salts; (15) iproniazid acid salts; (16) tripelennamine acid salts; and (17) mixtures thereof.

19. A migration imaging member according to claim 1 wherein the antistatic agent is selected from the group consisting of piperidine acid salt compounds and homopiperidine acid salt compounds.

20. A migration imaging member according to claim 1 wherein the antistatic agent is selected from the group consisting of (1) 2-(hexamethylene imino) ethyl chloride acid salts; (2) 3-(hexahydro-1H-azepin-1-yl)-3'-nitropropiophenone acid salts; (3) imipramine acid salts; (4) carbamezepine; (5) 5,6,11,12-tetrahydro dibenz[b,f]azocine acid salts; (6) 2-iminopiperidine acid salts; and (7) mixtures thereof.

21. A migration imaging member according to claim 1 wherein the antistatic agent is selected from the group consisting of quinoline acid salt compounds and isoquinoline acid salt compounds.

22. A migration imaging member according to claim 1 wherein the antistatic agent is selected from the group consisting of (1) 8-hydroxyquinoline acid salts; (2) 5-amino-8-hydroxy quinoline acid salts; (3) 2-(chloromethyl) quinoline acid salts; (4) 8-hydroxyquinoline-5-sulfonic acid salts; (5) 8-ethoxy-5-quinoline sulfonic acid salts; (6) 1,2,3,4-tetrahydroisoquinoline acid salts; (7) 1,2,3,4-tetrahydro-3-isoquinoline carboxylic acid acid salts; (8) 6,7-dimethoxy-1,2,3,4-tetrahydro isoquinoline acid salts; (9) 1-methyl-6,7-dihydroxy-1,2,3,4-tetrahydro isoquinoline acid salts; (10) primaquine acid salts; (11) pentaquine acid salts; (12) dibucaine acid salts; (13) 9-aminoacridine acid salts; (14) 3,6-diamino acridine acid salts; (15) 2-quinoline thiol acid salts; (16) sparteine acid salts; (17) papaverine acid salts; (18) emetine acid salts; (19) 1,10-phenanthroline acid salts; (20) neocuproine acid salts; and (21) mixtures thereof.

23. A migration imaging member according to claim 1 wherein the antistatic agent is selected from the group consisting of quinuclidine acid salt compounds.

24. A migration imaging member according to claim 1 wherein the antistatic agent is selected from the group consisting of (1) quinuclidine acid salts; (2) 3-quinuclidinol acid salts; (3) 3-quinuclidinone acid salts; (4) 2-methylene-3-quinuclidinone acid salts; (5) 3-amino quinuclidine acid salts; (6) 3-chloro quinuclidine acid salts; (7) quinidine acid salts; (8) quinine acid salts; (9) quinine acid salts; (10) hydroquinidine acid salts; (11) hydroquinine acid salts; and (12) mixtures thereof.

25. A migration imaging member according to claim 1 wherein the antistatic agent is selected from the group consisting of indole acid salt compounds and indazole acid salt compounds.

26. A migration imaging member according to claim 1 wherein the antistatic agent is selected from the group consisting of (1) tryptamine acid salts; (2) 5-methyl tryptamine acid salts; (3) serotonin acid salts; (4) norharman acid salts; (5) harmane acid salts; (6) harmine acid salts; (7) harmaline acid salts; (8) hattool acid salts; (9) harmalol acid salts; (10) 3,6-diamino acridine acid salts; (11) S-(3-indolyl-)isothiuronium salts; (12) yohimbine acid salts; (13) 4,5-dihydro-3-(4-pyridinyl)-2H-benz[g]indazole methane acid salts; and (14) mixtures thereof.

27. A migration imaging member according to claim 1 wherein the antistatic agent is selected from the group consisting of pyrimidine acid salt compounds.

28. A migration imaging member according to claim 1 wherein the antistatic agent is selected from the group consisting of (1) 2-hydroxypyrimidine acid salts; (2) 2-hydroxy-4-methyl pyrimidine acid salts; (3) 4,6-dimethyl-2-hydroxypyrimidine acid salts; (4) 2-mercapto-4-methyl pyrimidine acid salts; (5) 4,6-diamino pyrimidine acid salts; (6) 4,5,6-triamino pyrimidine acid salts; (7) 4,5-diamino-6-hydroxy pyrimidine acid salts; (8) 2,4-diamino-6-mercapto pyrimidine acid salts; (9) 2,4-diamino-6-hydroxy pyrimidine acid salts; (10) 6-hydroxy-2,4,5-triamino pyrimidine acid salts; (11) 5,6-diamino-2,4-dihydroxy pyrimidine acid salts; (12) $N^4$-(2 -amino-4-pyrimidinyl) sulfanilamide acid salts; (13) 4,5,6-triamino-2(1-H)-pyrimidinethione acid salts; (14) 2,4,5,6-tetraamino pyrimidine acid salts; (15) cyclocytidine acid salts; (16) cytosine arabinoside acid salts; and (17) mixtures thereof.

29. A migration imaging member according to claim 1 wherein the antistatic agent is selected from the group consisting of pyrazole acid salt compounds.

30. A migration imaging member according to claim 1 wherein the antistatic agent is selected from the group consisting of (1) 4-methyl pyrazole acid salts; (2) 3,4-diamino-5-hydroxy pyrazole acid salts; (3) 3,5-dimethyl pyrazole-1-carboxamidine acid salts; (4) 3-amino-4-pyrazole carboxamide acid salts; (5) 6-amino indazole acid salts; and (6) mixtures thereof.

31. A migration imaging member according to claim 1 wherein the antistatic agent is selected from the group consisting of oxazole acid salt compounds and isoxazole acid salt compounds.

32. A migration imaging member according to claim 1 wherein the antistatic agent is selected from the group consisting of (1) 3,3'-dimethyl oxacarbocyanine salts; (2) 2-ethyl-5-phenyl isoxazolium-3'-sulfonate salts; (3) 2-chloro-3-ethylbenzoxazolium salts; (4) 2-tert-butyl-5-methyl isoxazolium salts; (5) 5-phenyl-2-(4-pyridyl) oxazole salts; (6) 5 -phenyl-2-(4-pyridyl) oxazole salts; and (7) mixtures thereof.

33. A migration imaging member according to claim 1 wherein the antistatic agent is selected from the group consisting of morpholine acid salt compounds.

34. A migration imaging member according to claim 1 wherein the antistatic agent is selected from the group consisting of (1) 4-(2-chloroethyl) morpholine salts; (2) 4-morpholine ethane sulfonic acid; (3) 4-morpholine propane sulfonic acid; (4) β-hydroxy morpholine propane sulfonic acid; (5) [N-(aminoiminomethyl)-4-morpholine carboximidamide] acid salts; (6) 4-morpholine carbodithioic acid compound with morpholine; (7) 2,5-dimethyl-4-(morpholinomethyl) phenol acid salts; (8) 2-methoxy-4-morpholino benzene diazonium chloride salts; (9) 1-cyclohexyl-3-(2-morpholinoethyl) carbodiimide salts; (10) hemicholinium-3[2,2'-(4,4'-biphenylene) bis(2-hydroxy-4,4-dimethyl morpholinium) salts; (11) hemicholinium-15[4,4-dimethyl-2-hydroxy-2-phenyl morpholinium] salts; and (12) mixtures thereof.

35. A migration imaging member according to claim 1 wherein the antistatic agent is selected from the group consisting of thiazole acid salt compounds, thiazolidine acid salt compounds, and thiadiazole acid salt compounds.

36. A migration imaging member according to claim 1 wherein the antistatic agent is selected from the group consisting of (1) 2-amino-4,5-dimethyl thiazole acid salts; (2) 2-amino 4-imino-2-thiazoline acid salts; (3) 2-amino-2-thiazoline acid salts; (4) 2-amino-5-bromothiazole acid salts; (5) 5-amino-3-methyl isothiazole acid salts; (6) 2,2,5,5-tetramethyl-4-thiazolidine carboxylic acid acid salts; (7) 3-methyl-2-benzothiazolinone hydrazone acid salts; (8) 5-amino-2-methylbenzothiazole acid salts; (9) 2,4 -diamino-5-phenyl thiazole acid salts; (10) 2-amino-4-phenyl thiazole acid salts; (11) 2-(tritylamino)-α-(methoxyimino)-4-thiazole acetic acid acid salts; (12) 2,3,5,6-tetrahydro-6-phenylimidazo[2,1-b]thiazole acid salts; and (13) mixtures thereof.

37. A migration imaging member according to claim 1 wherein the antistatic agent is selected from the group consisting of phenothiazine acid salt compounds.

38. A migration imaging member according to claim 1 wherein the antistatic agent is selected from the group consisting of (1) trifluoroperazine acid salts; (2) thioridazine acid salts; (3) promethazine acid salts; (4) ethopropazine acid salts; (5) chlorpromazine acid salts; and (6) mixtures thereof.

39. A process which comprises (a) providing a migration imaging member comprising (1) a substrate; (2) a softenable layer situated on one surface of the substrate, said softenable layer comprising a softenable material and a photosensitive migration marking material; and (3) an antistatic layer situated on the surface of the substrate opposite to the surface in contact with the softenable layer, said antistatic layer containing an antistatic agent selected from the group consisting of amine acid salt compounds, pyrrole acid salt compounds, pyrrolidine acid salt compounds pyridine acid salt compounds, piperidine acid salt compounds homopiperidine acid salt compounds, quinoline acid salt compounds, isoquinoline acid salt compounds, quinuclidine acid salt compounds, indole acid salt compounds, indazole acid salt compounds, pyrimidine acid salt compounds, pyrazole acid salt compounds, oxazole acid salt compounds, isoxazole acid salt compounds, morpholine acid salt compounds, thiazole acid salt compounds, thiazolidine acid salt compounds, thiadiazole acid salt compounds, phenothiazine acid salt compounds, and mixtures thereof; (b) uniformly charging the imaging member; (c) imagewise exposing the charged imaging member to activating radiation at a wavelength to which the migration marking material is sensitive; and (d) subsequent to step (c), causing the softenable material to soften and enabling a first portion of the migration marking material to migrate through the softenable material toward the substrate in an imagewise pattern while a second portion of the migration marking material remains substantially unmigrated within the softenable layer.

* * * * *